US012269654B2

(12) United States Patent
Connolly

(10) Patent No.: US 12,269,654 B2
(45) Date of Patent: Apr. 8, 2025

(54) APPARATUS FOR INTERACTIVE FOLDED MULTI-CHAMBER CONTAINER

(71) Applicant: Sean Michel Connolly, Paterson, NJ (US)

(72) Inventor: Sean Michel Connolly, Paterson, NJ (US)

( * ) Notice: Subject to any disclaimer, the term of this patent is extended or adjusted under 35 U.S.C. 154(b) by 0 days.

(21) Appl. No.: 17/492,608

(22) Filed: Oct. 2, 2021

(65) Prior Publication Data

US 2023/0159215 A1 May 25, 2023

Related U.S. Application Data

(60) Provisional application No. 63/086,996, filed on Oct. 2, 2020.

(51) Int. Cl.
*B65D 5/49* (2006.01)
*B65D 47/10* (2006.01)

(52) U.S. Cl.
CPC ..... *B65D 5/48026* (2013.01); *B65D 47/10* (2013.01); *B65D 2203/06* (2013.01)

(58) Field of Classification Search
CPC ..... B65D 5/48026; B65D 47/10; B65D 2203/06; B65D 5/48014; B65D 5/58; B65D 3/08; B65D 5/42; B65D 5/029; B65D 5/40; B65D 2203/00; B65D 2231/022; B65D 2517/0056; B65D 17/4012; B65D 5/067; B65D 75/008; B65D 81/3283; B65D 5/064; B65D 5/48; B65D 5/48002; B65D 81/3288; B65D 25/04
USPC ..... 229/120.02, 125.42, 137; 220/525, 529, 220/524; 222/129, 94; D7/513, 534
See application file for complete search history.

(56) References Cited

U.S. PATENT DOCUMENTS

| | | | | |
|---|---|---|---|---|
| 3,347,444 | A | 10/1967 | Rausing et al. | |
| 3,795,359 | A | 3/1974 | Rausing | |
| 4,126,263 | A | 11/1978 | Martensson | |
| 4,655,386 | A | 4/1987 | Billberg | |
| 4,775,096 | A | 10/1988 | Andersson et al. | |
| 4,955,503 | A * | 9/1990 | Propes | A47G 19/2266 220/555 |
| 5,118,036 | A | 6/1992 | Mandersson | |

(Continued)

FOREIGN PATENT DOCUMENTS

| | | |
|---|---|---|
| KR | 200272994 | 4/2002 |
| KR | 20160149505 A * | 12/2016 |

*Primary Examiner* — Christopher R Demeree
(74) *Attorney, Agent, or Firm* — Erickson Law Group, PC

(57) ABSTRACT

A multi-chamber container, such as a drinking box or a beverage can, with an educational function. The multi-chamber container is designed to provide a housing, with a sidewall extending between a bottom wall and a top wall, that can store food or beverage substances therein. The housing includes a primary chamber and at least one secondary chamber. The primary chamber is accessible via a primary opening, while each secondary chamber is individually accessible via a secondary opening. The container provides an educational function in that the primary chamber stores a desired liquid or solid material and the secondary chamber is empty. The primary and secondary openings are indistinguishable to the consumer until opened from a closed state. The selection of the primary opening corresponds to a correct answer to a question displayed on, or associated with, the container.

24 Claims, 34 Drawing Sheets

(56) References Cited

U.S. PATENT DOCUMENTS

| | | | | |
|---|---|---|---|---|
| 5,267,646 | A | 12/1993 | Inoue et al. | |
| 5,938,107 | A | 8/1999 | Anchor et al. | |
| 10,322,841 | B2 * | 6/2019 | Dahan | B65D 81/3216 |
| 11,930,943 | B2 | 3/2024 | Connolly | |
| 2004/0118710 | A1 | 6/2004 | Bourque et al. | |
| 2005/0109796 | A1 | 5/2005 | Bourque et al. | |
| 2006/0160051 | A1 | 7/2006 | Trowbridge-Kitchens | |
| 2006/0219719 | A1 * | 10/2006 | Dixon | B65D 81/3288 220/495.06 |
| 2007/0246379 | A1 | 10/2007 | Kuenzel | |
| 2007/0267416 | A1 | 11/2007 | Eichenbaum | |
| 2008/0240628 | A1 | 10/2008 | Vanloock et al. | |
| 2018/0009566 | A1 * | 1/2018 | Muhammad | B65D 5/0227 |

* cited by examiner

APPARATUS FOR INTERACTIVE FOLDED MULTI-CHAMBER CONTAINER

This application claims the benefit of U.S. Provisional application No. 63/086,996 filed Oct. 2, 2020.

BACKGROUND

Many individuals, such as children, enjoy juice boxes or single-serving snack packages. Also, many individuals, such as children enjoy soft drinks served in a beverage can with a pop-top or pull tab opening. These individuals, however, may not enjoy various school-related activities, such as homework or studying. Typically, younger individuals may not have a developed appreciation for their academic development or education. It is generally known that students who study will perform better than students who choose not to study. It is also generally known that students will retain information more easily if they are interested in the information. Many teachers and parents have tried to develop innovative and interesting ways to capture the attention of students and children, however, many methods are time-intensive or are simply ineffective.

Therefore, there is a defined need amongst the known art for a device that will stimulate students and children in a manner that will entice them to be more interested in learning. The device should utilize a system that provides a reward for a student that is able to correctly identify an answer to a question.

SUMMARY

In view of the foregoing disadvantages inherent in the known types of containers now present in the prior art, the present invention provides a multi-chamber container wherein the same can be utilized for providing convenience for the user when containing liquid and food materials.

The present invention provides a multi-chamber container. More specifically, the present invention provides a system with which a user can engage in a knowledge-testing activity while eating food or consuming liquids.

An exemplary embodiment container of the invention comprises a housing. The housing defines a bottom wall with a sidewall that extends upwardly from the bottom wall. The housing additionally includes a top wall opposite the bottom wall, such that the housing is a self-contained unit. A plurality of chambers are internally defined in the housing. The plurality of chambers includes a primary chamber and at least one secondary chamber. The primary chamber includes a primary opening, such that the primary chamber can be accessed by a user via the primary opening. Each secondary chamber individually includes at least one secondary opening, such that each secondary chamber can be individually accessed by a user via the specific secondary opening. As such, the user can access each chamber of the plurality of the chambers from the outside of the housing.

An exemplary embodiment includes a drinking box formed of folded inner and outer sheets, wherein reverse folding of the inner sheet at corners of the box can provide primary and secondary channels between the inner and outer sheets within the drinking box. Primary and secondary openings on the top wall communicate into primary and secondary chambers within the drinking box. Another exemplary embodiment includes a beverage can with a pop top opener. The beverage can may include a sub-wall beneath the top wall that segregates an inside of the can into primary and secondary chambers. Two wall portions on a top of the beverage can may be selectively opened by rotation and positioning of the pop top and actuation thereof by pulling up the pop top ring. For both these embodiments the primary and secondary opening areas are marked with an indicator corresponding to correct or incorrect answers to a question, the question and multiple-choice answers provided to the user. Opening the primary opening area will result in access to the primary chamber while opening the secondary opening area will result in only access to the secondary chamber. Advantageously, the primary chamber corresponds to the desired contents of the container while the secondary chamber is either dry or has a limited amount of beverage.

A particular enhancement of the invention is the incorporation of an educational function into the container. A user is presented with a question, either displayed on the container or on a tag or packaging thereof, or on a mobile device. The user is also provided with multiple answers displayed in like manner as the question. The answers have indicia associated with each answer, such as A, B, C, D and the primary and secondary openings on the top wall have the same corresponding indicia A, B, C, D displayed adjacent to or on each opening. The indicia for the correct answer will be displayed adjacent to or on the primary opening while the incorrect answers will be displayed adjacent to, or on the secondary openings. Depending on the questions, the correct answer could be any of answer choices A, B, C, or D and the correct answer choice corresponds to the primary opening.

The primary and secondary openings are indistinguishable by a user from an outside of the container. If the user picks the correct answer and opens the opening associated with the same indicia as his or her answer, the user will be opening the primary opening and will gain access to the contents of the primary chamber. If the user selects an incorrect answer and opens the opening on the top wall of the container having the same indicia as his or her answer, the user will open the secondary opening and will access the secondary chamber. According to the exemplary embodiment, the primary chamber holds the desired contents of the container while the secondary chamber is empty or contains a secondary fluid or material.

Some of the exemplary embodiments described herein provide an efficient way of making or manufacturing a multi-chamber container that can be made from pure recyclable material and can be compatible towards being in compliance with the Aseptic filling system used by juice filling companies in order to preserve quality and promote longer shelf life.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION

Figure 1:
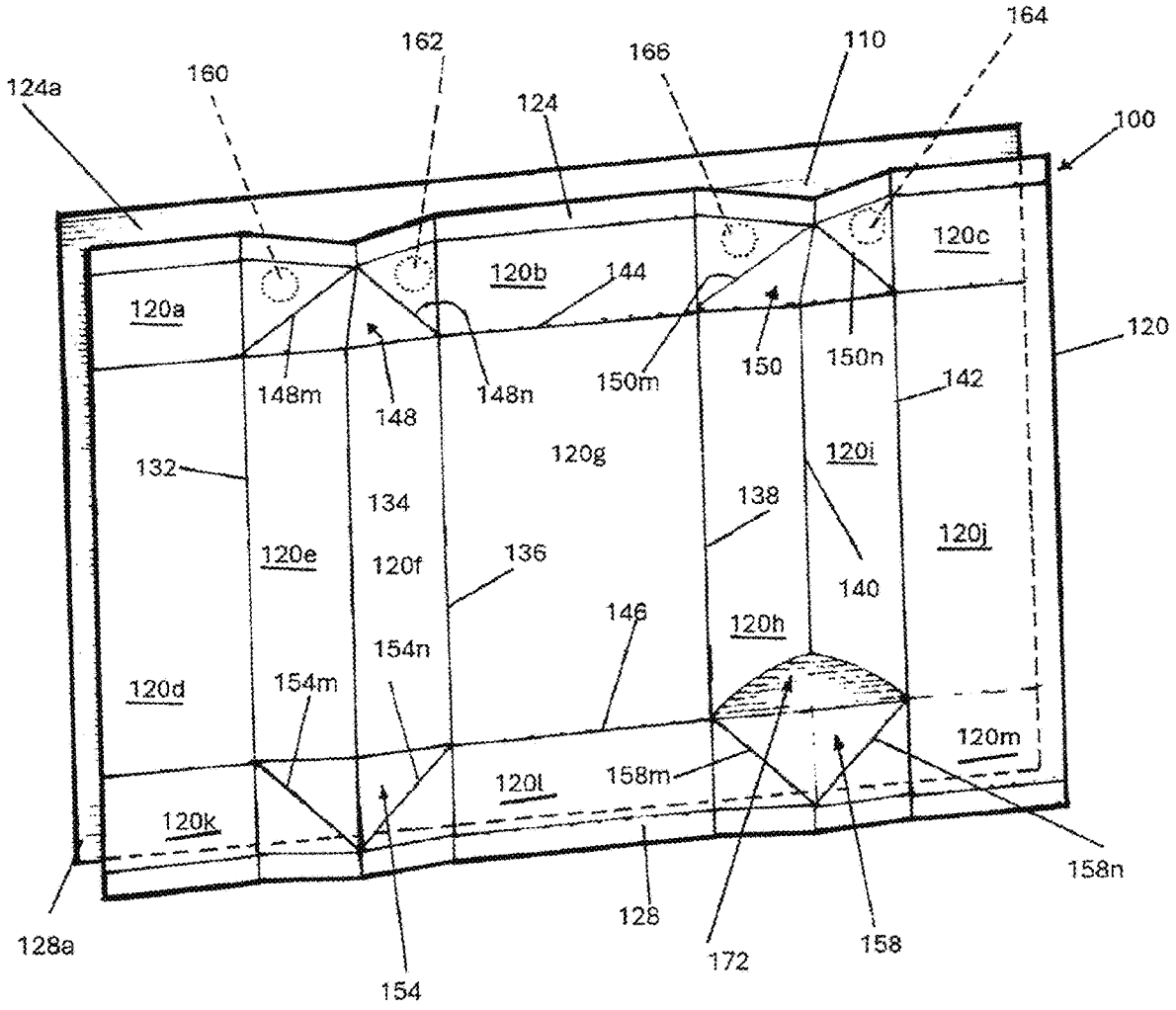
FIG. 1 is a front perspective view of a first step of manufacturing a drink container of the present invention.

Reference is made herein to the attached drawings. Like reference numerals are used throughout the drawings to depict like or similar elements of the multi-chamber container. The figures are intended for representative purposes only and should not be considered to be limiting in any respect.

This application incorporates by reference U.S. Provisional application Ser. No. 62/833,160, filed Apr. 12, 2019, U.S. Non-provisional application Ser. No. 16/817,362 filed Mar. 12, 2020 and U.S. Provisional application No. 63/086,996 filed Oct. 2, 2020, all in their entireties.

FIG. 1 illustrates a first step of assembling and manufacturing a drink pouch or drink box 100 of the present invention. The drink box can be manufactured and composed of materials as described in U.S. Pat. Nos. 5,938,107; 5,118,036; 4,775,096; 4,655,386; 4,126,263; 3,347,444; and 3,795,359, all herein incorporated by reference to the extent they are not contrary to the teaching of the present invention, and made available commercially from Tetra Laval Holdings & Finance S.A. of Switzerland. The drink box 100 comprises an outside sheet 110 and an inside sheet 120. The inside sheet 120 forms an inside layer of the drink box and the outside sheet 110 forms an outside layer of the drink box. The inside sheet 120 includes a top sealing band 124 and a bottom sealing band 128. The inside sheet includes six vertical fold lines 132, 134, 136, 138, 140, 142 extending a length of the inside sheet and two horizontal fold lines 144, 146 extending a width of the inside sheet 120. The inside sheet 120 includes two top gusset areas 148, 150 and two bottom gusset areas 154, 158. The top gusset area 148 includes gusset fold lines 148*m*, 148*n*. The top gusset area 150 includes two gusset fold lines 150*m*, 150*n*. The bottom gusset area 154 includes two gusset fold lines 154*m*, 154*n*. Bottom gusset area 158 includes two gusset fold lines 158*m*, 158*n*. The gusset areas 148, 150, 154, 158 are folded to extend outward with respect to the plane of FIG. 1 (toward the viewer).

The vertical and horizontal fold lines and gusset areas define top panels 120*a*, 120*b*, 120*c*, side panels 120*d*, 120*e*, 120*f*, 120*g*, 120 *h*, 120*i*. 120*j* and bottom panels 120*k*, 1201 and 120*m*.

The inside sheet 120 also includes an open area 172 adjacent to the bottom gusset area 158 along the horizontal fold line 146, extending upwardly in an approximate triangular shape.

The outside sheet 110 is a mirror image of the inside sheet 120 regarding size and folds, except having no opening 172. The outside sheet 110. includes a top sealing band 124*a* and a bottom sealing band 128*a*. The outside sheet includes six vertical fold lines 132*a*, 134*a*, 136*a*, 138*a*, 140*a*, 142*a* extending a length of the outside sheet and two horizontal fold lines 144*a*, 146*a* extending a width of the outside sheet 110. The outside sheet 110 includes two top gusset areas 148*a*, 150*a* and two bottom gusset areas 154*a*, 158*a*. The top gusset area 148*a* includes gusset folds 148*o*, 148*p*. The top gusset area 150*a* includes two gusset folds 150*o*, 150*p*. The bottom gusset area 154*a* includes two gusset fold lines 154*o*, 154*p*. Bottom gusset area 158*a* includes two gusset folds 158*o*, 158*p*.

The vertical and horizontal fold lines and gusset areas define top panels 110*a*, 110*b*, 110*c*, side panels 110*d*, 110*e*, 110*f*, 110*g*, 110 *h*, 110*i*. 110*j* and bottom panels 110*k*, 110*l* and 110*m*.

When the two sheets 110, 120 are sealed together, a first channel 202 into the box is formed between the two sheets from the top gusset areas 148, 148*a* to the bottom gusset areas 154, 154*a* and a second channel 204 is formed between the top gusset areas 150, 150*a* and the bottom gusset areas 158, 158*a*. The first channel 202 is closed from top to bottom, while the second channel 204 is closed at the top but open through the opening 172 at the bottom gusset area 158 of the inner sheet 120, into a center reservoir 208 of the box.

The top gusset area 148*a* includes two weakened circles 160, 162 and the top gusset area 150*a* includes two weakened circles 164, 166. The weakened circles are areas of access wherein a straw can be punched through the circles.

Figure 2:
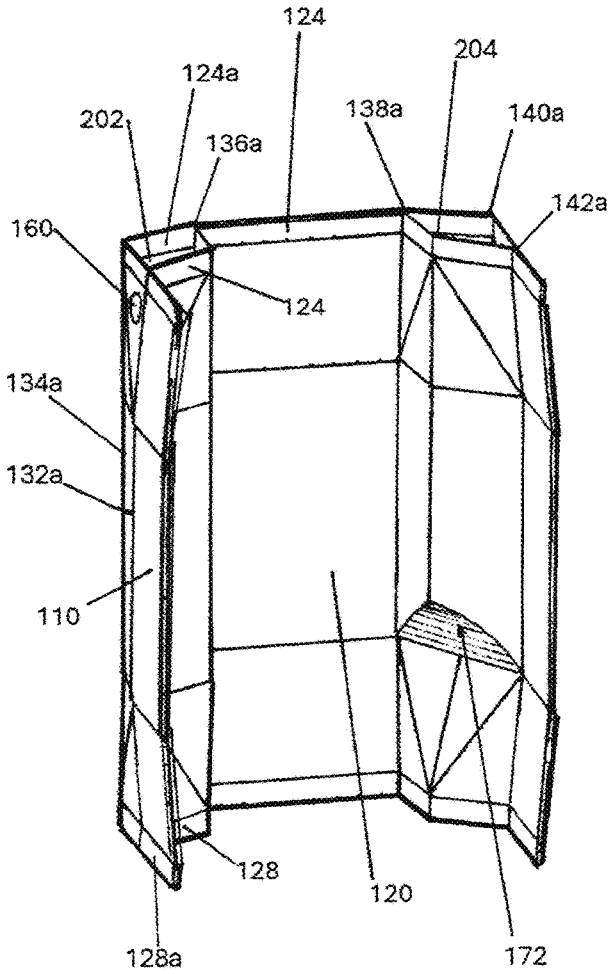
FIG. 2 is a front perspective view of a second step of manufacturing the drink container of FIG. 1.
Figure 3:
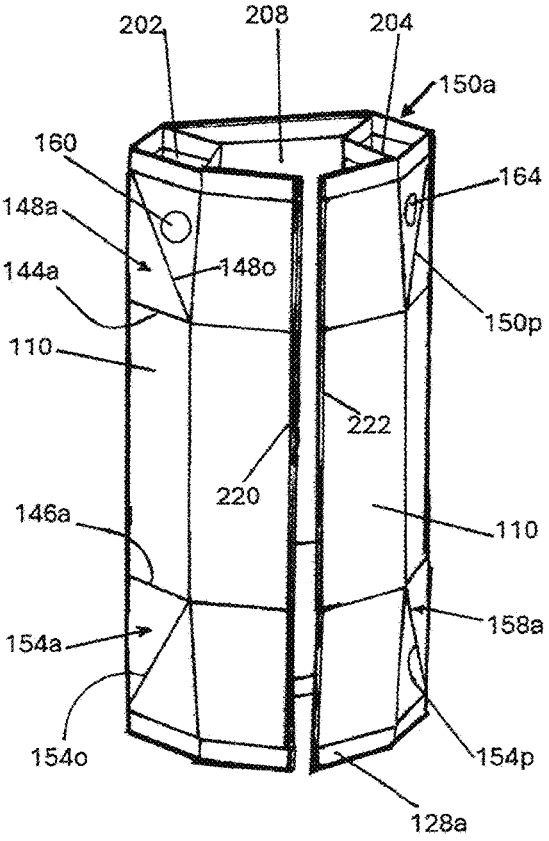
FIG. 3 is a front perspective view of a third step of manufacturing the drink container of FIG. 1.

As shown in FIGS. 2 and 3, the outside sheet 110 includes substantially mirror image gusset areas with substantially mirror image gusset folds as the inside sheet 120.

Figure 4:
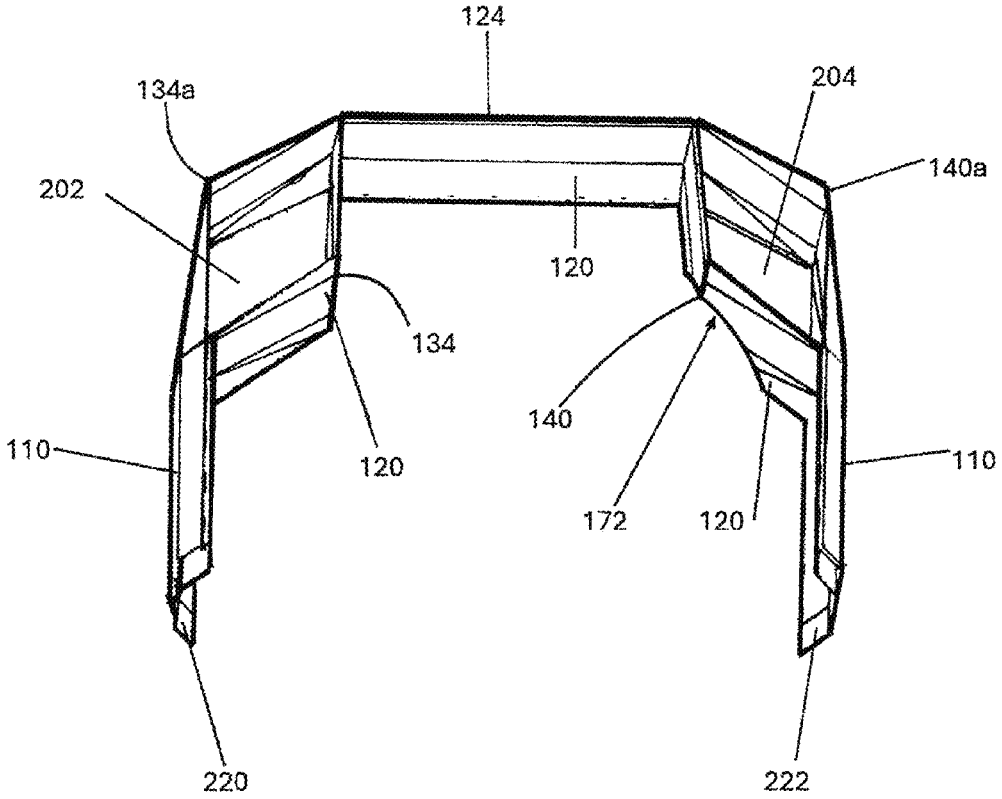
FIG. 4 is a top perspective view of the drink container shown in FIG. 2.
Figure 5:
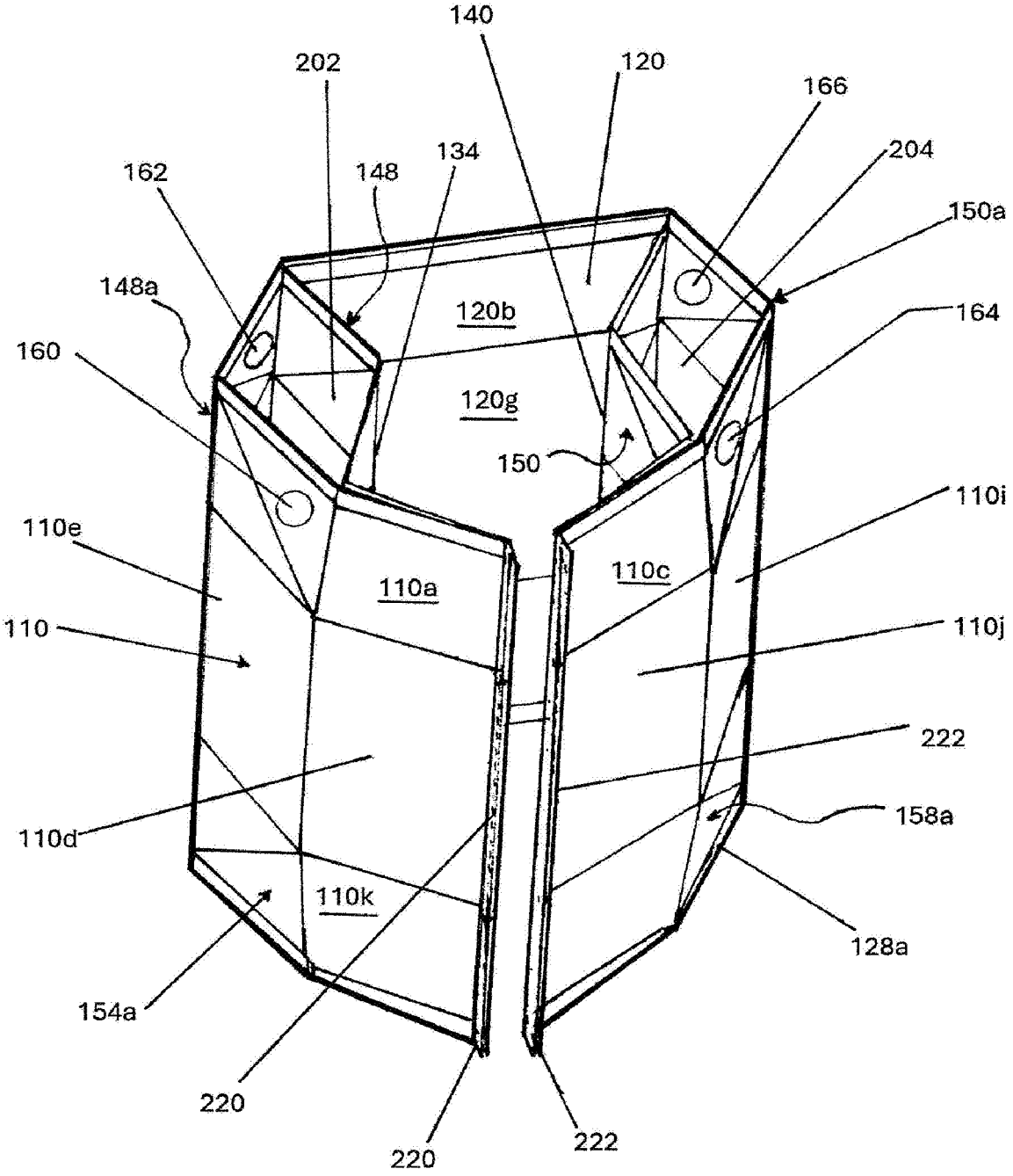
FIG. 5 is a further top perspective view of the drink container shown in FIG. 2.
Figure 6:
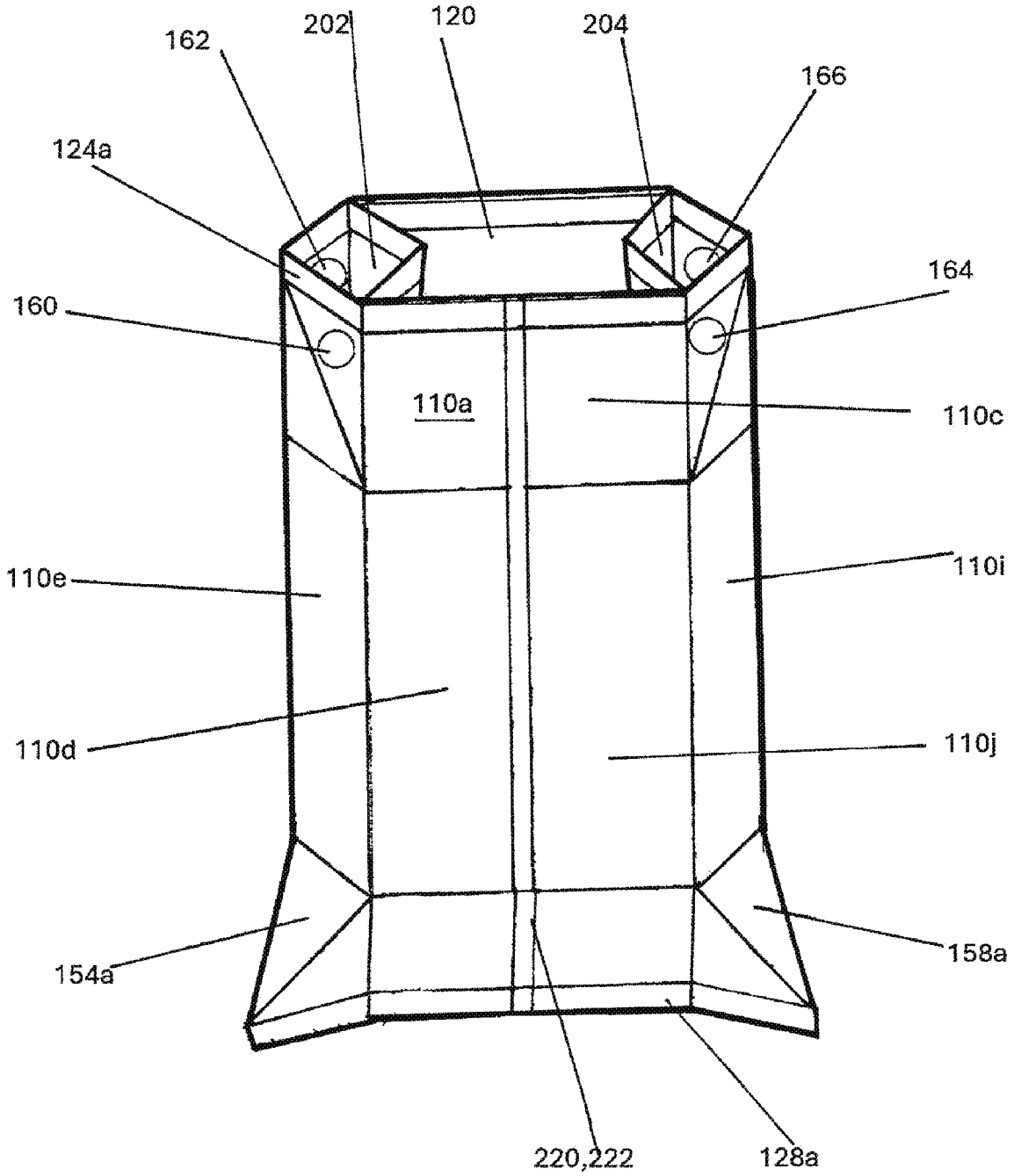
FIG. 6 is a perspective view of a fourth step of manufacturing the drink container of FIG. 1.
Figure 7:
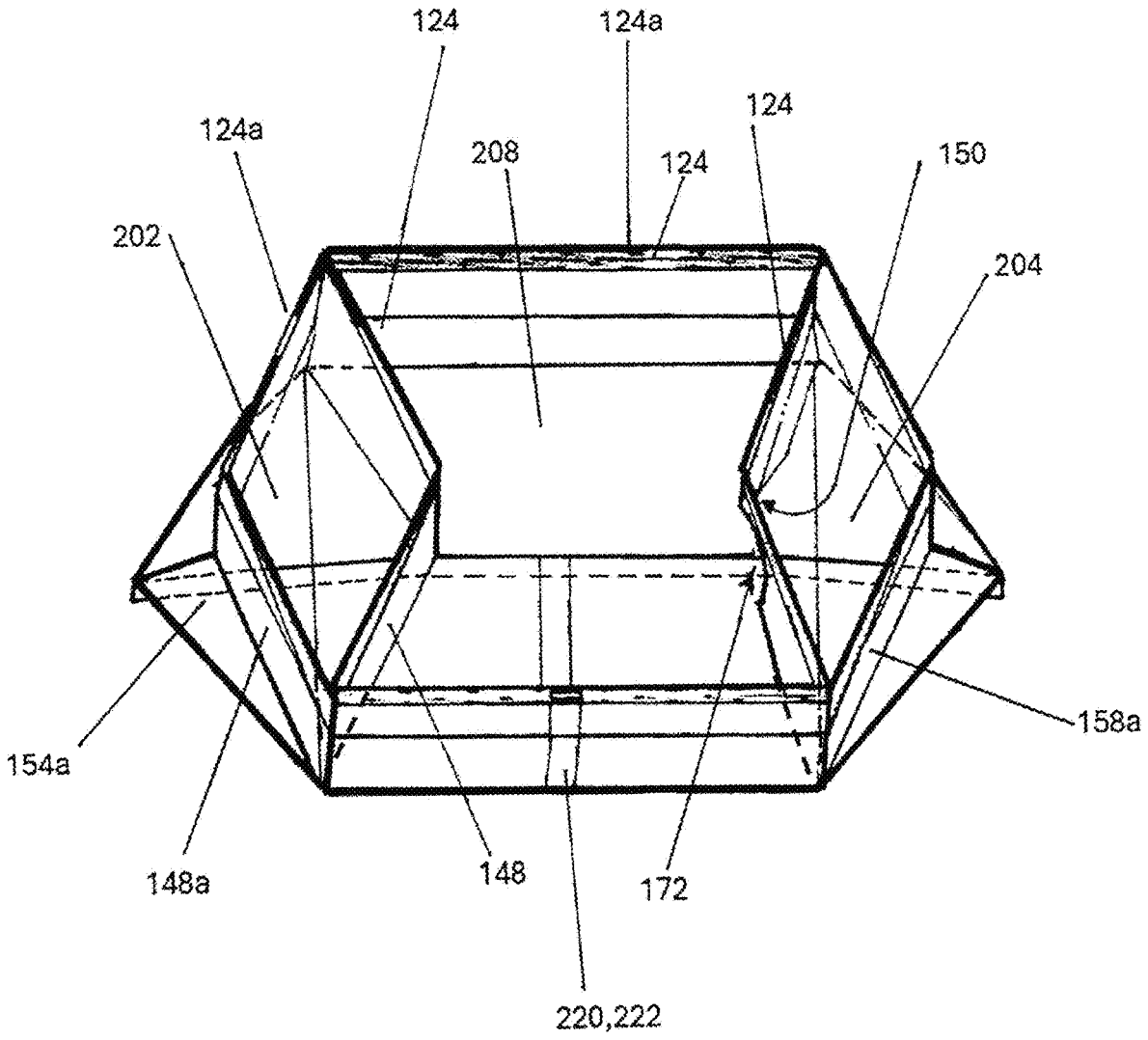
FIG. 7 is a top perspective view of the drink container shown in FIG. 6.
Figure 8:
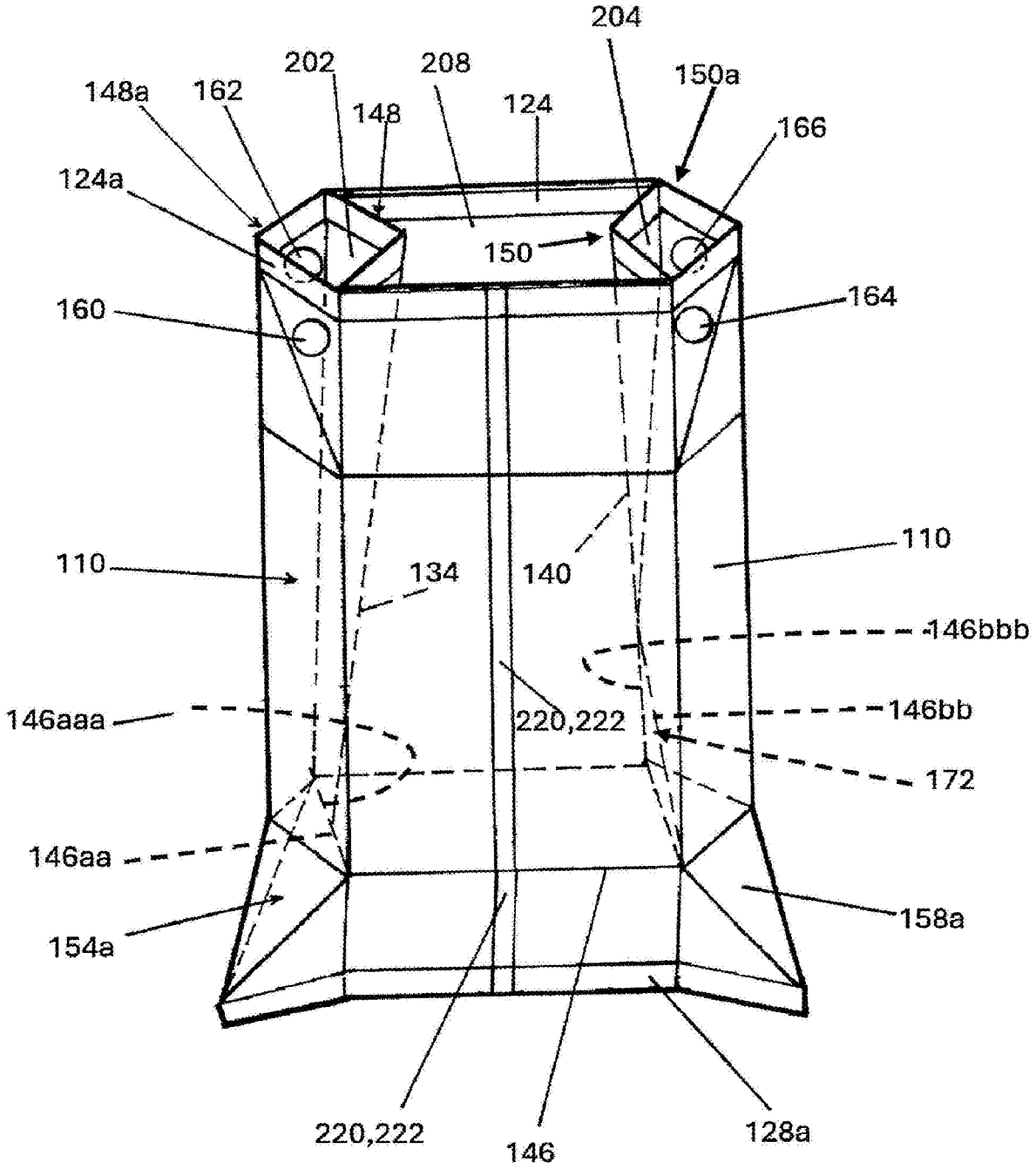
FIG. 8 is a perspective view of FIG. 6 showing inside elements.
Figure 9:
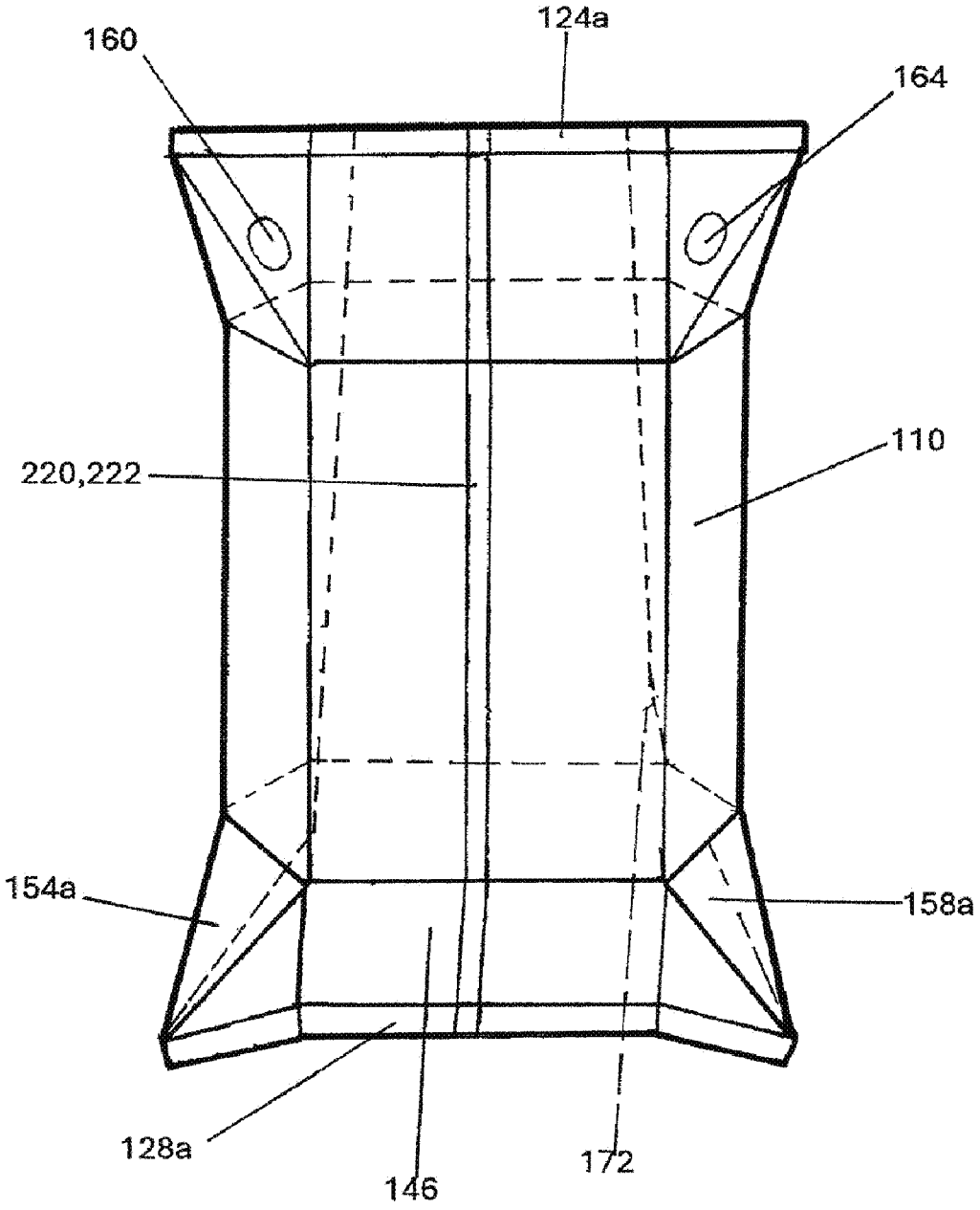
FIG. 9 is a front view of the drink container of FIG. 8.

As shown in FIGS. 3-5, a first vertical sealing band 220 can be provided on a left edge of the box and a second vertical sealing band 222 can be provided on the right edge. As shown in FIG. 6, the bands 220, 222 can be overlapped and sealed forming a vertical seam in the box.

FIGS. 6-9 show the container of FIG. 5 with the gusset areas 154*a*, 158*a* folded outward. The inner gussets 154, 158 fold outwardly to be in close conformity to the outer gussets 154*a*, 158*a*. The inner gussets 148, 150 fold inwardly to be spaced from the outer gussets 148*a*, 150*a*.

Figure 10:
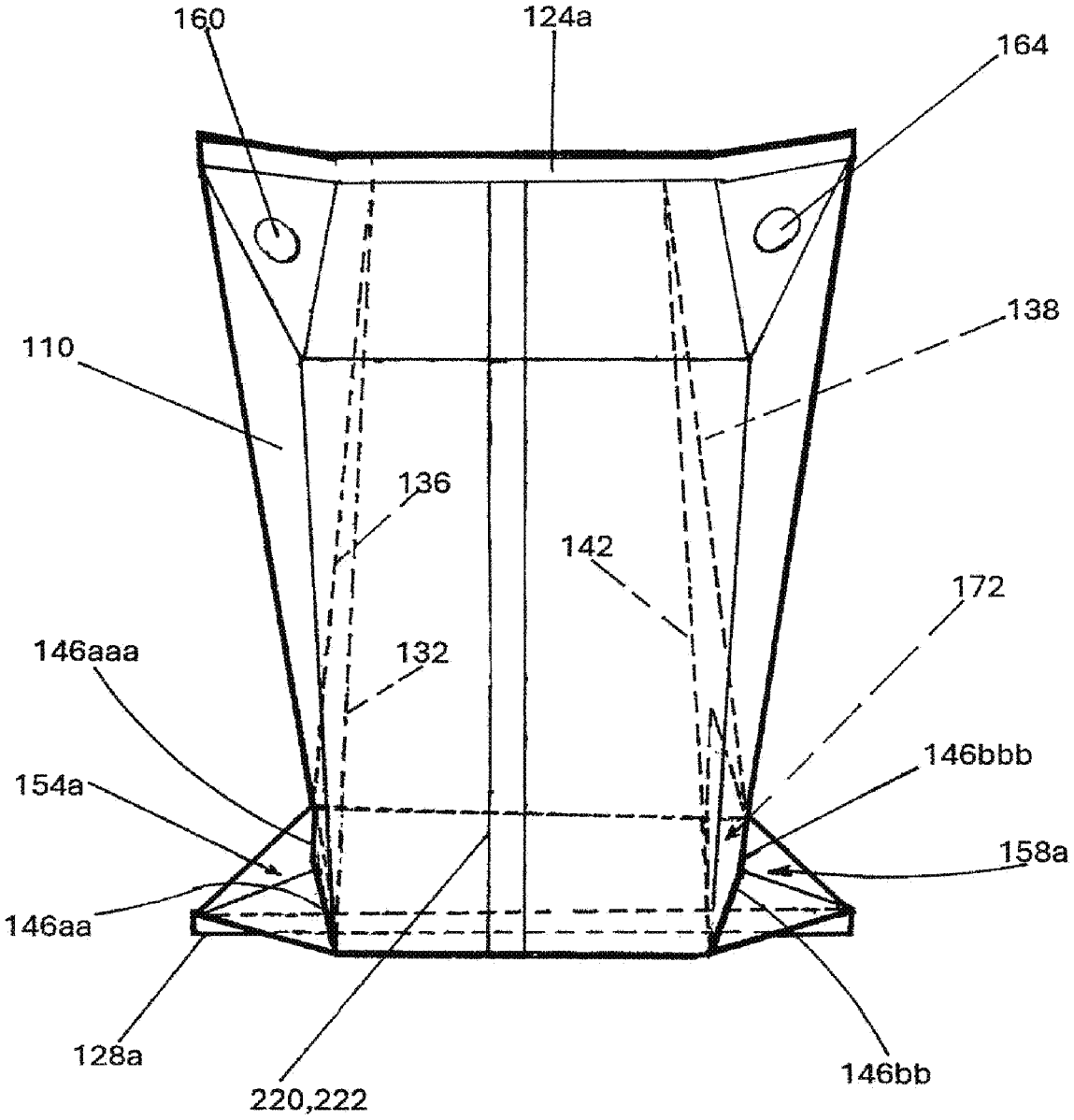
FIG. 10 is a front perspective view of a sixth step of manufacturing the drink container of FIG. 1.

FIG. 10 shows the top and bottom seals 124, 124*a* and 128, 128*a* after sealing along the top bands 125, 124*a*, the bottom bands 128, 128*a* and along the vertical bands 220, 222.

Figure 11:
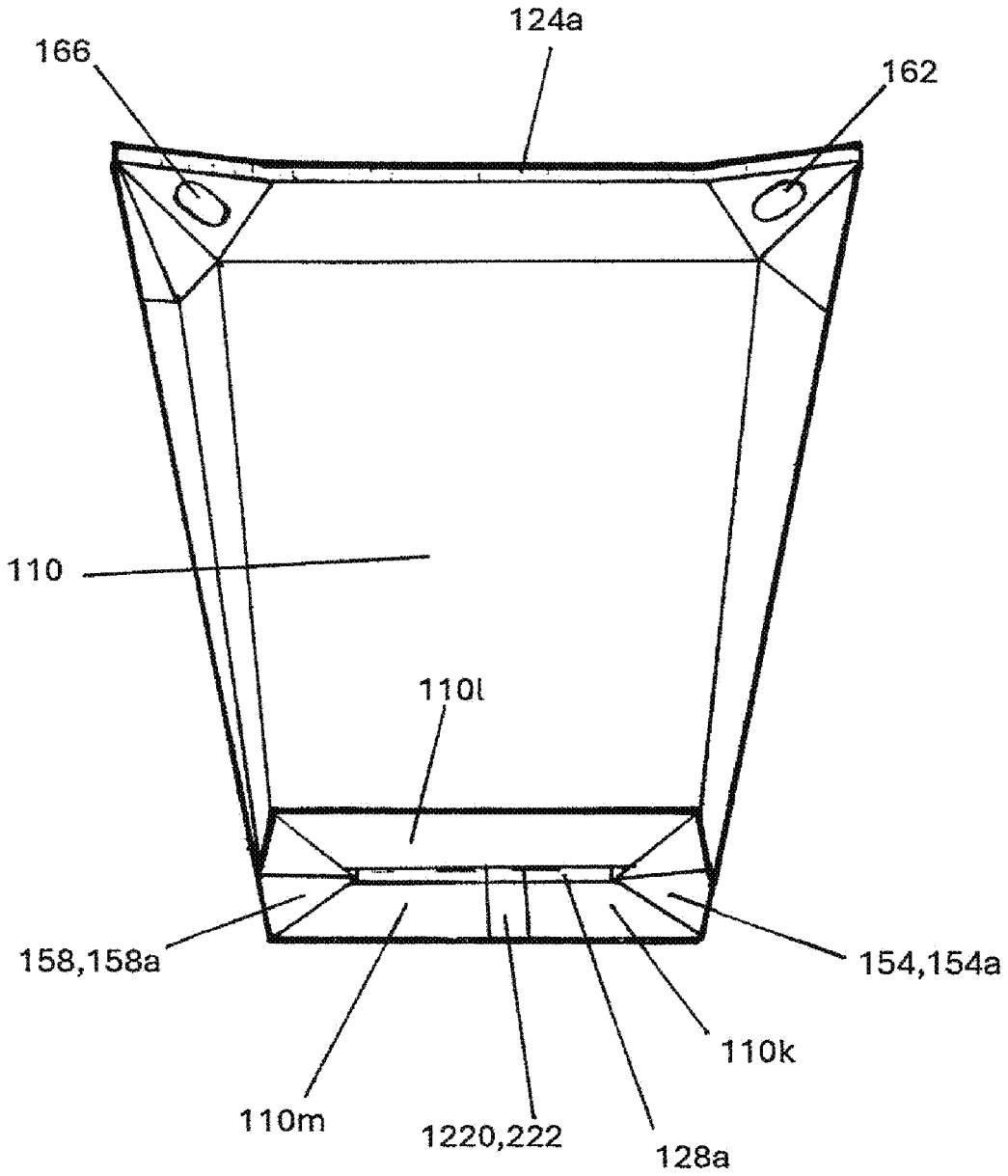
FIG. 11 is a bottom perspective view of a seventh step of manufacturing the drink container of FIG. 1.
Figure 12:
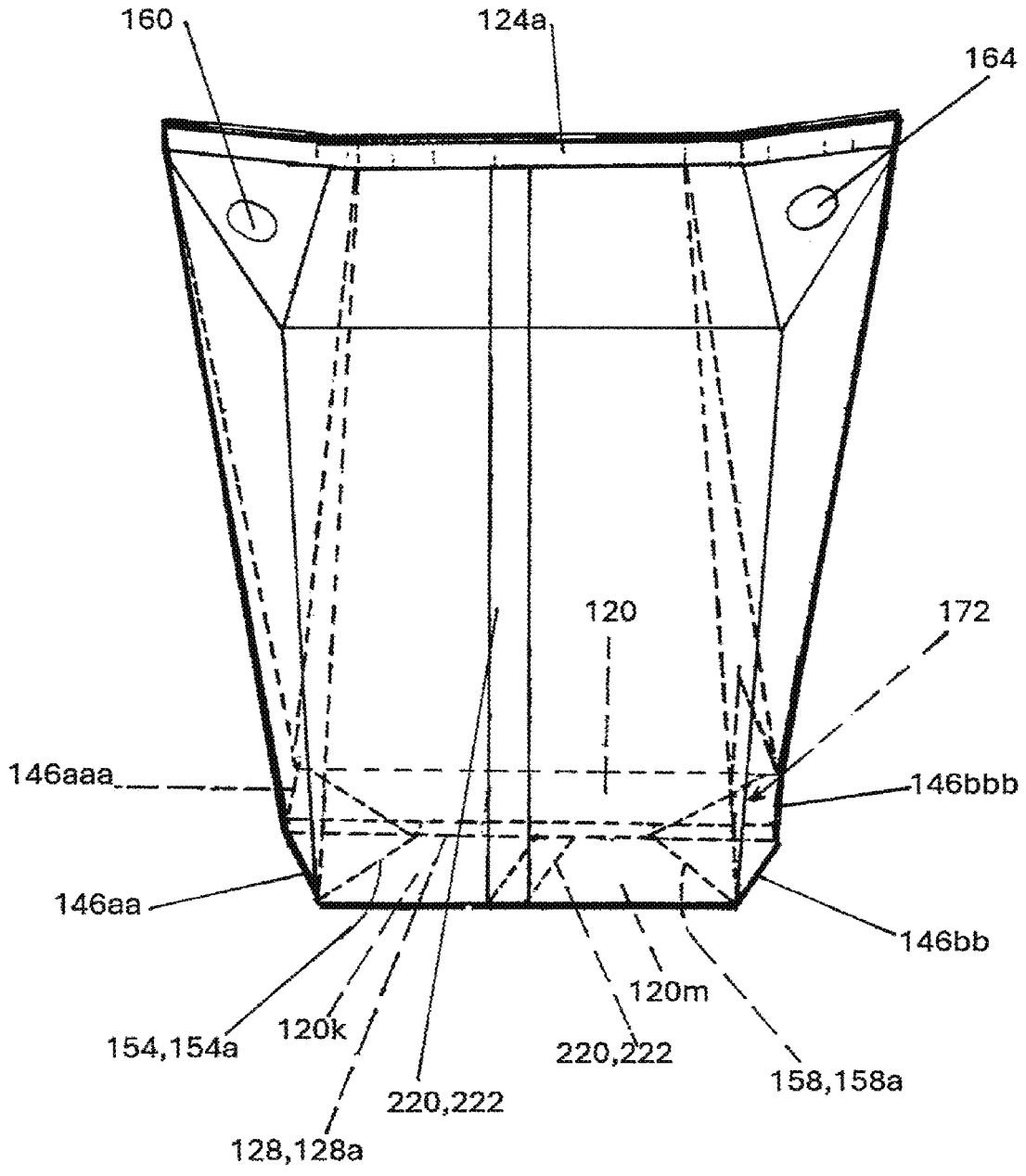
FIG. 12 is a front perspective view of the drink container shown in FIG. 11.

FIGS. 11 and 12 illustrates that the bottom bands 128, 128*a* have been folded flat and the gussets 154, 154*a* and 158, 158*a* have been folded under bottom walls 110*l*, 120*l*; 110*k*, 120*k*; 110*m*, 120*m* and sealed thereto.

The finished container has a substantially flat bottom wall and a top wall with an inverted V-shaped cross section.

FIGS. 11 and 12 show the gusset areas 154, 154*a*, and 158, 158*a* folded under bottom panels 110*l*, 110*k*, 110*m* and sealed thereto.

Figure 13:
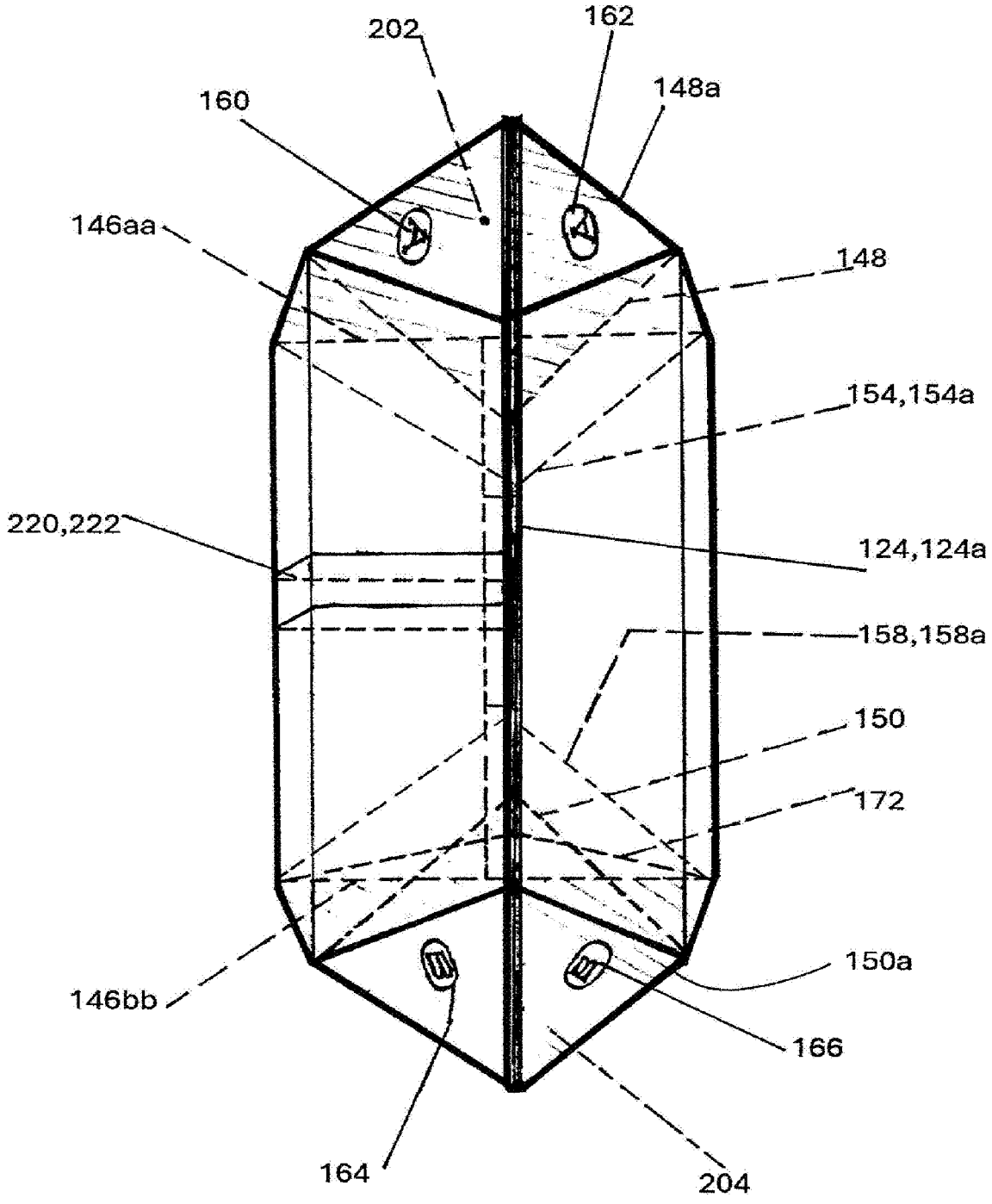
FIG. 13 is a top view of the drink container shown in FIG. 12.

FIG. 13 shows the weakened circles 160. 162 corresponding to answer "A" and weakened circles 164, 166 corresponding to answer "B."

The channel 202 is sealed at the top and open behind the weakened circles 160, 162, but effectively closed along the fold line portions 146*aa*, 146*aaa* of the horizontal fold 146. The channel 204 is sealed at the top and open behind the weakened circles 164, 166 but effectively closed along the fold line portions 146*bb*, 146*bbb* of the horizontal fold 146. The channel 204 is open into the reservoir 208 via the opening 172.

Figure 14:
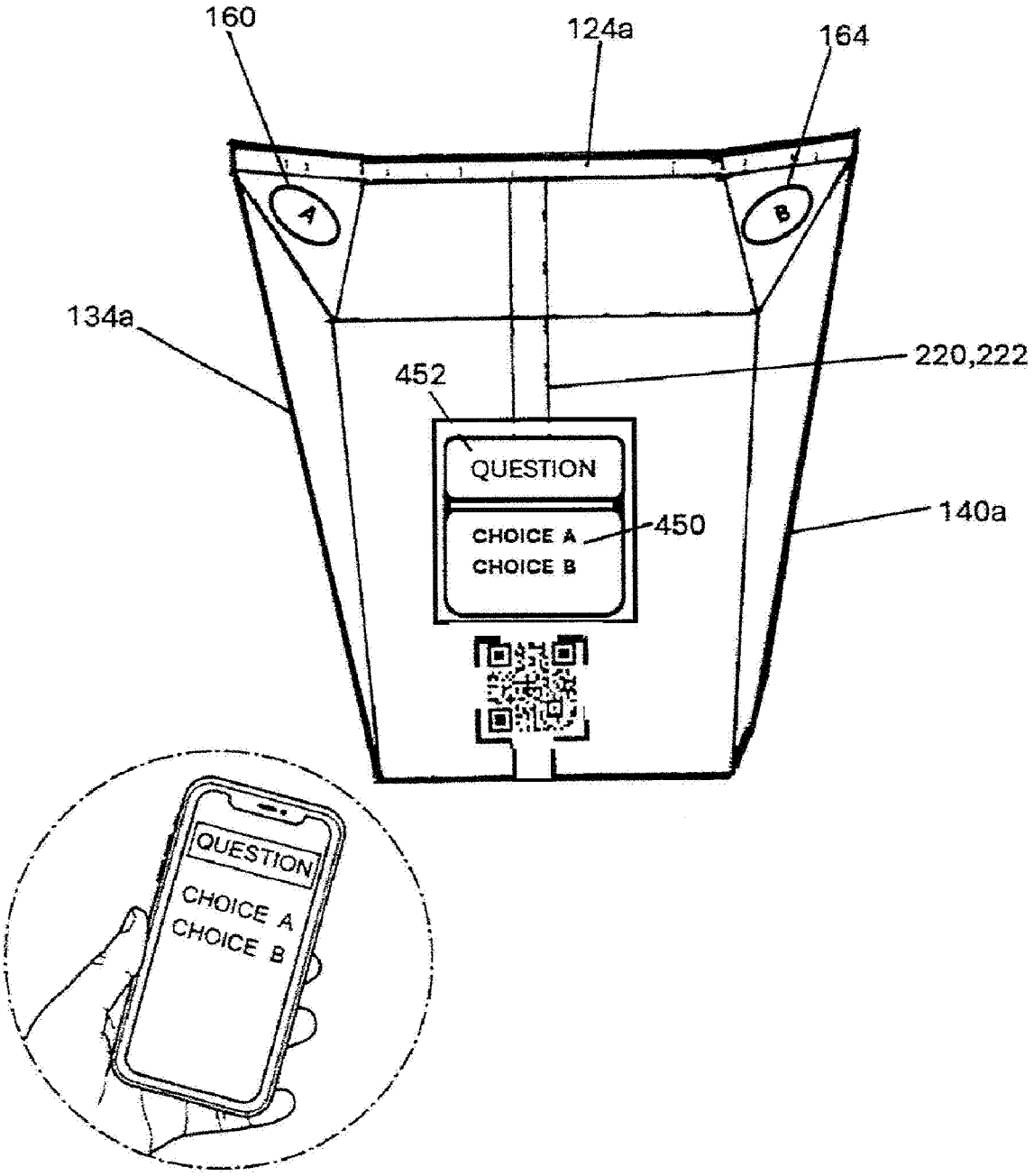
FIG. 14 is a front perspective view of the drink container shown in FIG. 12.

FIG. 14 shows the finished product. A label 450 is applied with a question 452 and two answer choices "A" and "B". The answer choice "A" corresponds to the weakened circles 160, 162 and the answer choice "B" corresponds to the weakened circles 164, 166. According to the illustrated embodiment answer choice "B" would be the correct answer to the question and corresponds to the primary opening, and a straw pushed through either weakened circle 164, 166 would deliver liquid from the reservoir 108 into the channel 104 via the opening 172 to the user sipping through the straw. The answer choice "A" would be the incorrect answer and corresponds to the secondary opening, and a straw pushed through either weakened circle 160, 162 would access the closed channel 102 and no liquid would be delivered through the straw. The manufacturing of the container would assure that the correct answer would alternately be "A" or "B" requiring the user to make a correct selection to access an open channel. In other words, the opening 172 would be placed in either channel 102 or 104 and would correspond to the correct answer "A" or "B."

Although the exemplary embodiment can be advantageously configured for the game or educational purpose, it is also encompassed by the invention that a multi-chamber container is provided that can have different chambers holding different products, liquid or solid.

As an alternate to the label 450, an electronically readable tag, such as a bar code, can be used that can be scanned by an electronic device that reveals the question-and-answer choices. The tag may be of any suitable configuration to be scanned by a device, such as a traditional bar code, a QR code, or any similar representation. This is explained further in FIGS. 29 and 30.

Figure 15:
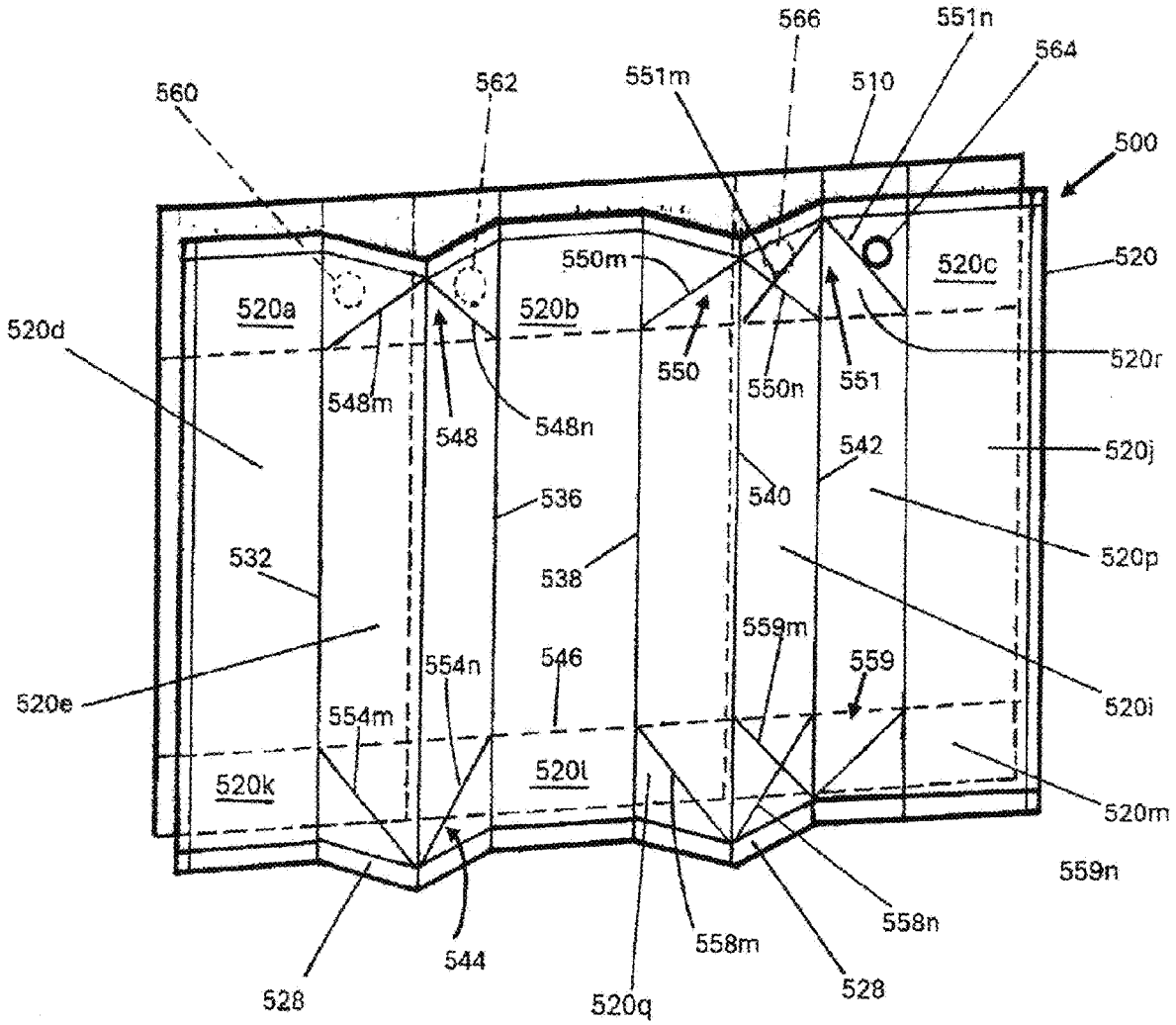
FIG. 15 is a front perspective view of a first step of manufacturing a drink container of the present invention.
Figure 16:
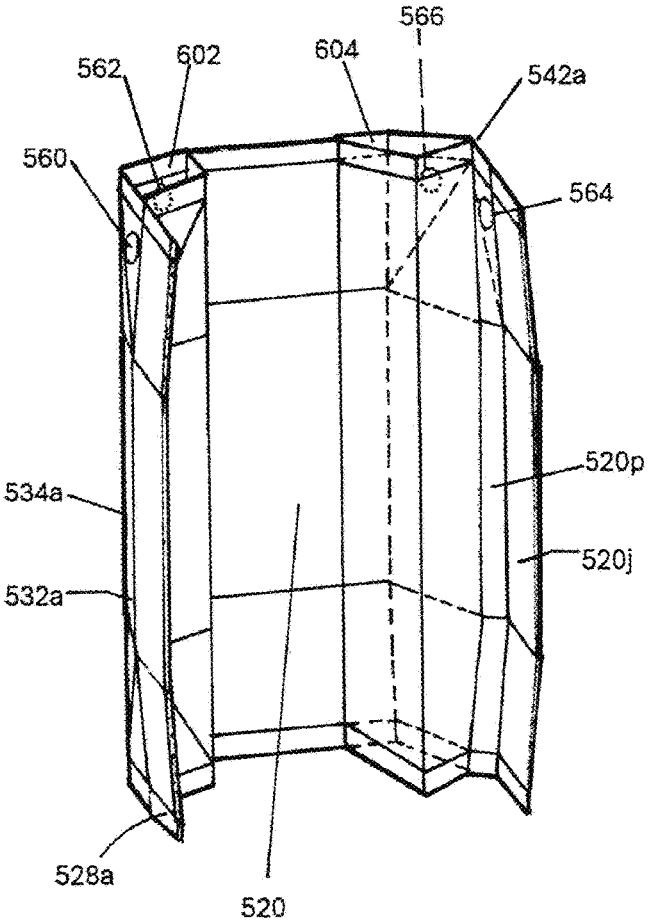
FIG. 16 is a front perspective view of a second step of manufacturing the drink container of FIG. 15.

FIG. 15 illustrates a first step of assembling and manufacturing a second drink box 500 of the present invention. The drink box 500 comprises an outside sheet 510 and an inside sheet 520. The inside sheet 520 forms an inside layer of the drink box and the outside sheet 510 forms an outside layer of the drink box. The inside sheet 520 includes a top sealing band 154 and a bottom sealing band 528. The inside sheet includes seven vertical fold lines 532, 534, 536, 538, 540, 542, 544 extending a length of the inside sheet and two horizontal fold lines 544, 546 extending a width of the inside sheet 520. The inside sheet 520 includes three top gusset areas 548, 550, 551 and three bottom gusset areas 554, 558, 559. The top gusset area 548 includes gusset fold lines 548*m*, 548*n*. The top gusset area 550 includes two gusset folds 550*m*, 550*n*. The top gusset area 551 includes two gusset folds 551*m*, 551*n*. The gusset fold 551*m* forms an "X" with the gusset fold 550*n*. The bottom gusset area 554 includes two gusset fold lines 554*m*, 554*n*. Bottom gusset area 558 includes two gusset fold lines 558*m*, 558*n*. Bottom gusset area 559 includes two gusset folds 559*m*, 559*n*. The gusset fold 559*m* forms an "X" with the gusset fold 558*n*. The gusset areas 548, 550, 554, 558 are folded to extend outward with respect to the plane of FIG. 15 (toward the viewer). The gusset areas 550 and 551 overlap. The gusset areas 558, 559 overlap.

The vertical and horizontal fold lines and gusset areas define top panels 520*a*, 520*b*, 520*c*, 520*r*, side panels 520*d*, 520*e*, 520*f*, 520*g*, 520*h*, 520*i*, 520*p*, 520*j* and bottom panels 520*k*, 5201, 520*q* and 520*m*.

Figure 22:
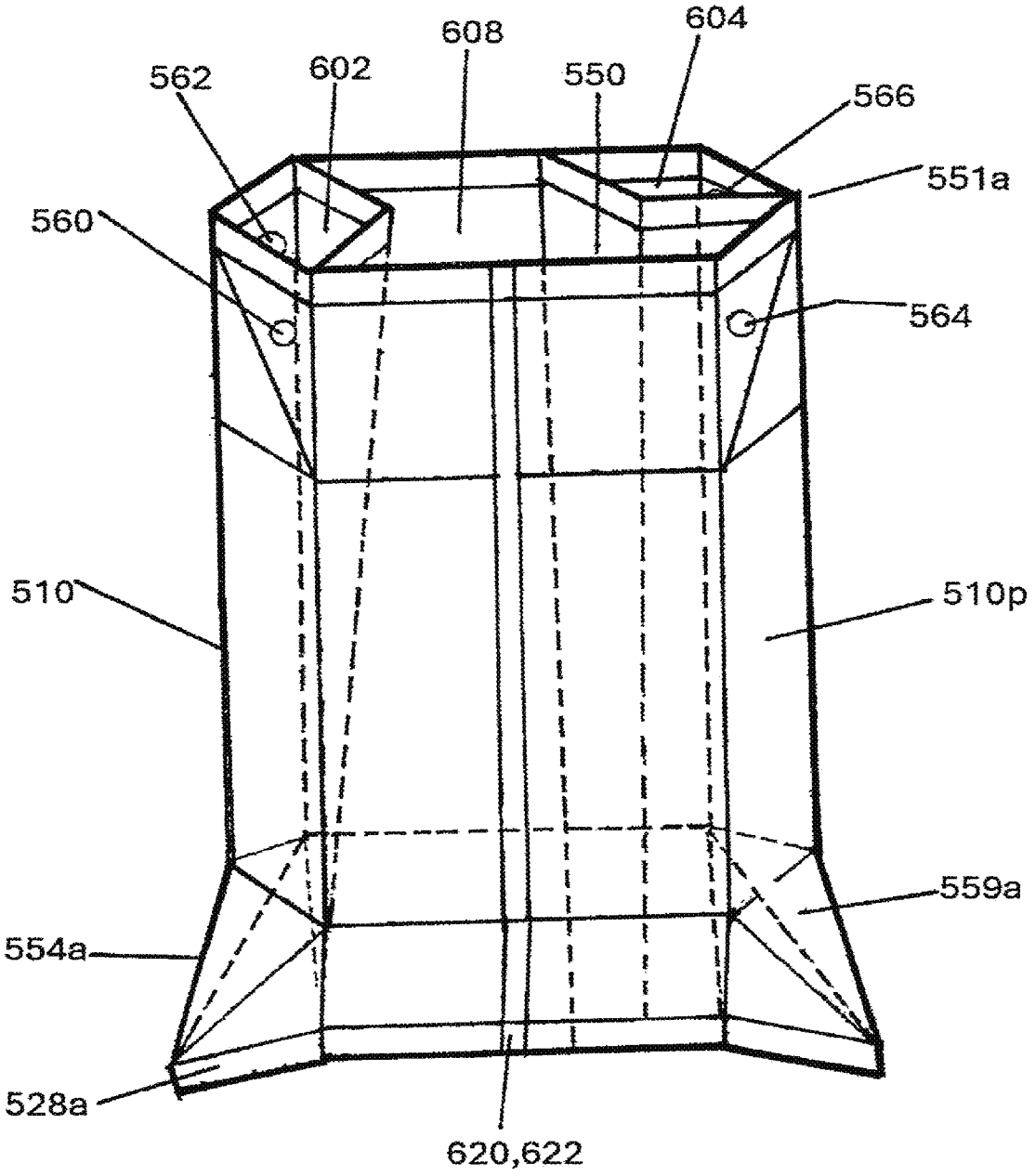
FIG. 22 is a front perspective view of the drink container of FIG. 20, showing inside elements.
Figure 23:
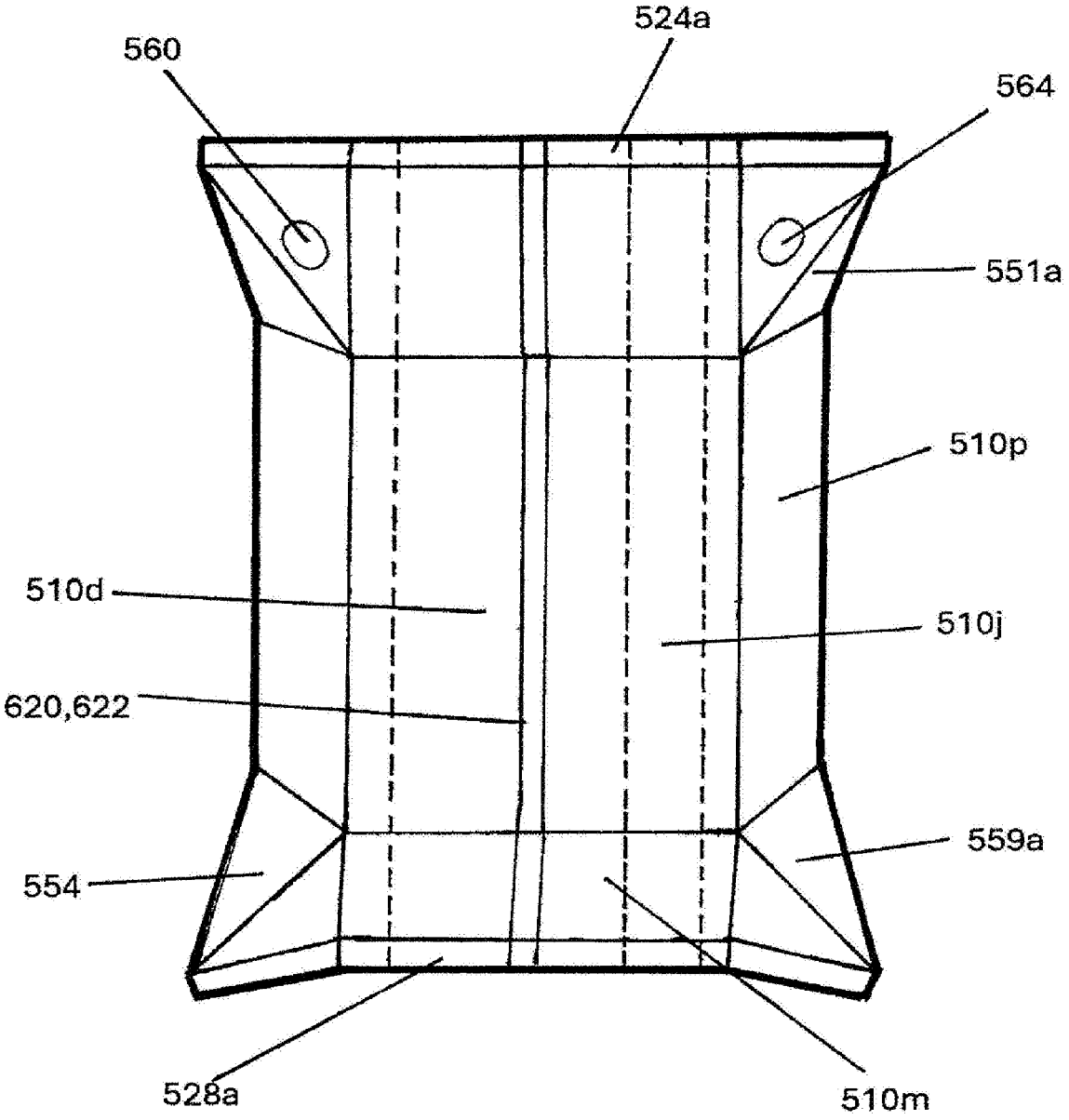
FIG. 23 is a front perspective view of a fifth step of manufacturing the drink container of FIG. 15.

The outside sheet 510 is a mirror image of the inside sheet 520 regarding size and folds on one side (the left side of FIG. 22) and modified compared to the first embodiment on another side (the right side of FIG. 22). The outside sheet 510 is substantially configured the same as the prior described outside sheet 110. The outside sheet 510 includes a top sealing band 524*a* and a bottom sealing band 528*a*. The outside sheet includes six vertical fold lines 532*a*, 534*a*, 536*a*, 538*a*, 540*a*, 542*a* extending a length of the outside sheet and two horizontal fold lines 544*a*, 546*a* extending a width of the outside sheet 510. The outside sheet 510 includes two top gusset areas 548*a*, 551*a* and two bottom gusset areas 554*a*, 559*a*. The top gusset area 548*a* includes gusset folds 548*o*, 548*p*. The top gusset area 551*a* includes two gusset folds 551*o*, 551*p*. The bottom gusset area 554*a* includes two gusset fold lines 554*o*, 554*p*. Bottom gusset area 559*a* includes two gusset folds 559*o*, 559*p*.

The vertical and horizontal fold lines and gusset areas define top panels 510*a*, 510*b*, 510*c*, side panels 510*d*, 510*e*, 510*f*, 510*g*, 510*h*, 510*i*, 510*j* and bottom panels 510*k*, 5101 and 510*m*.

When the two sheets 510, 520 are sealed together, a first channel 602 into the box is formed between the two sheets from the top gusset areas 548, 548*a* to the bottom gusset areas 554, 554*a* and a second channel 604 is formed between the top gusset areas 550, 551*a* and the bottom gusset areas 558, 559*a*. The first channel 602 the second channel 604 are closed from top to bottom. The top gusset area 548*a* includes two weakened circles 560, 562 and the top gusset area 550*a* includes one weakened circle, 566. Penetrating the weakened circles 560, 562 will gain access into the channel 602. Penetrating the weakened circle 566 will gain access into the channel 604. The channels 602, 604 can be empty or hold a secondary product. Only penetrating the weakened circle 564 will access the reservoir 608 directly for delivery of a primary product.

Figure 17:
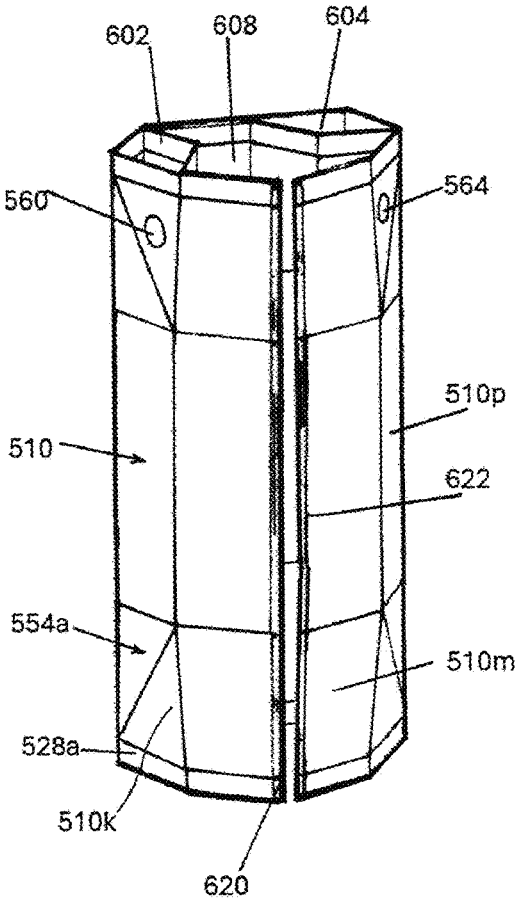
FIG. 17 is a front perspective view of a third step of manufacturing the drink container of FIG. 15.
Figure 18:
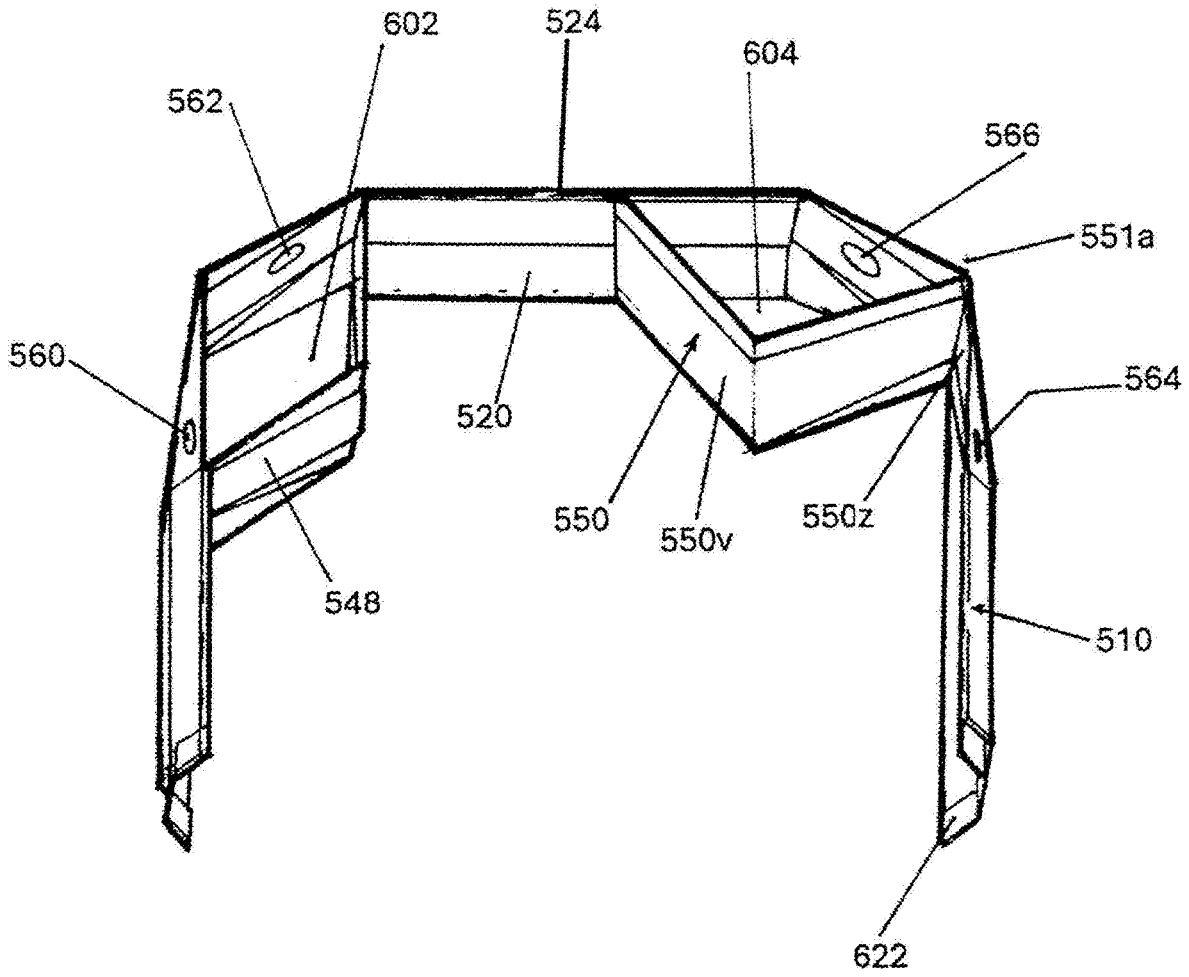
FIG. 18 is a top perspective view of the drink container shown in FIG. 16.
Figure 19:
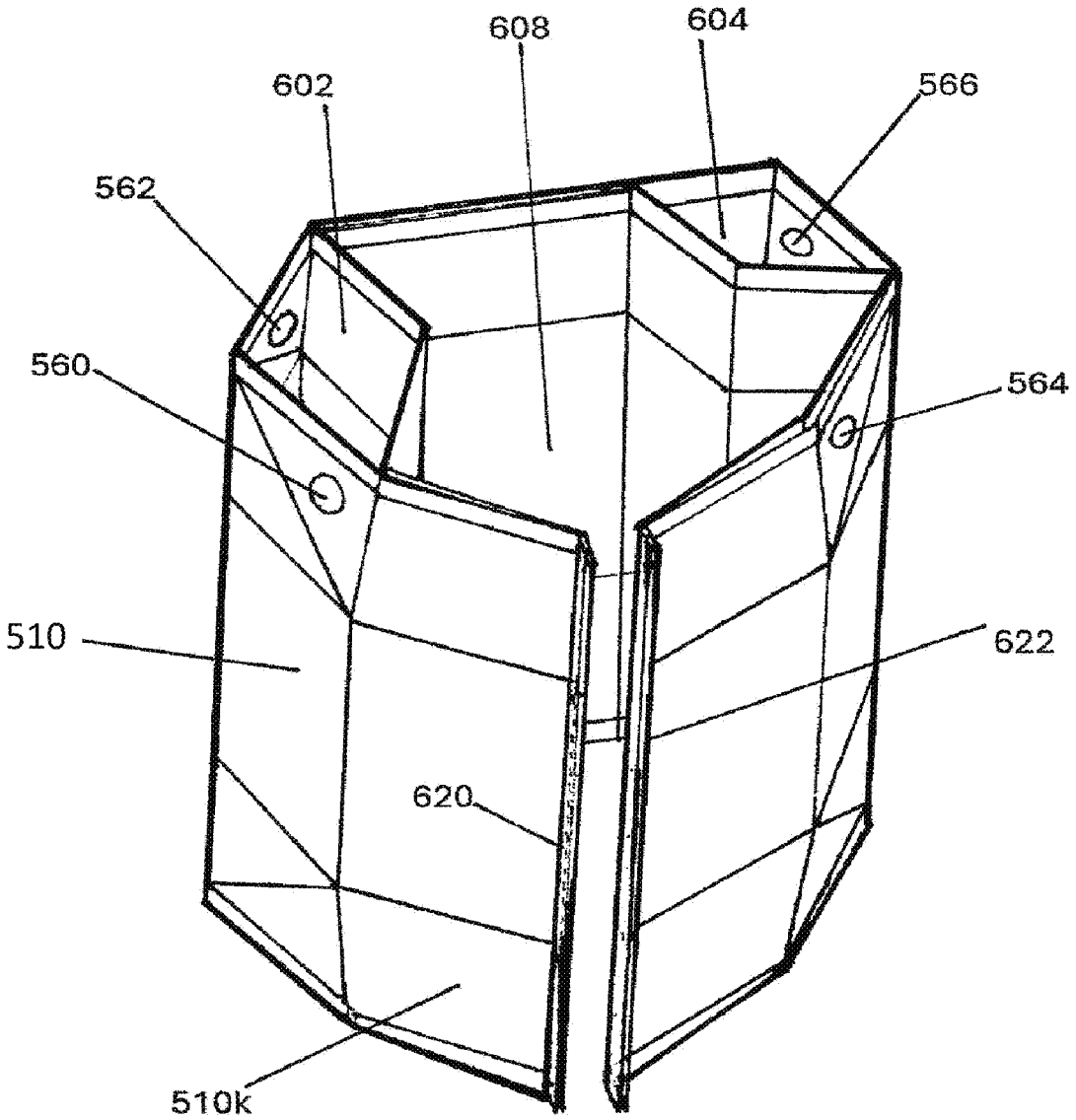
FIG. 19 is a top perspective view of the drink container shown in FIG. 17.
Figure 20:
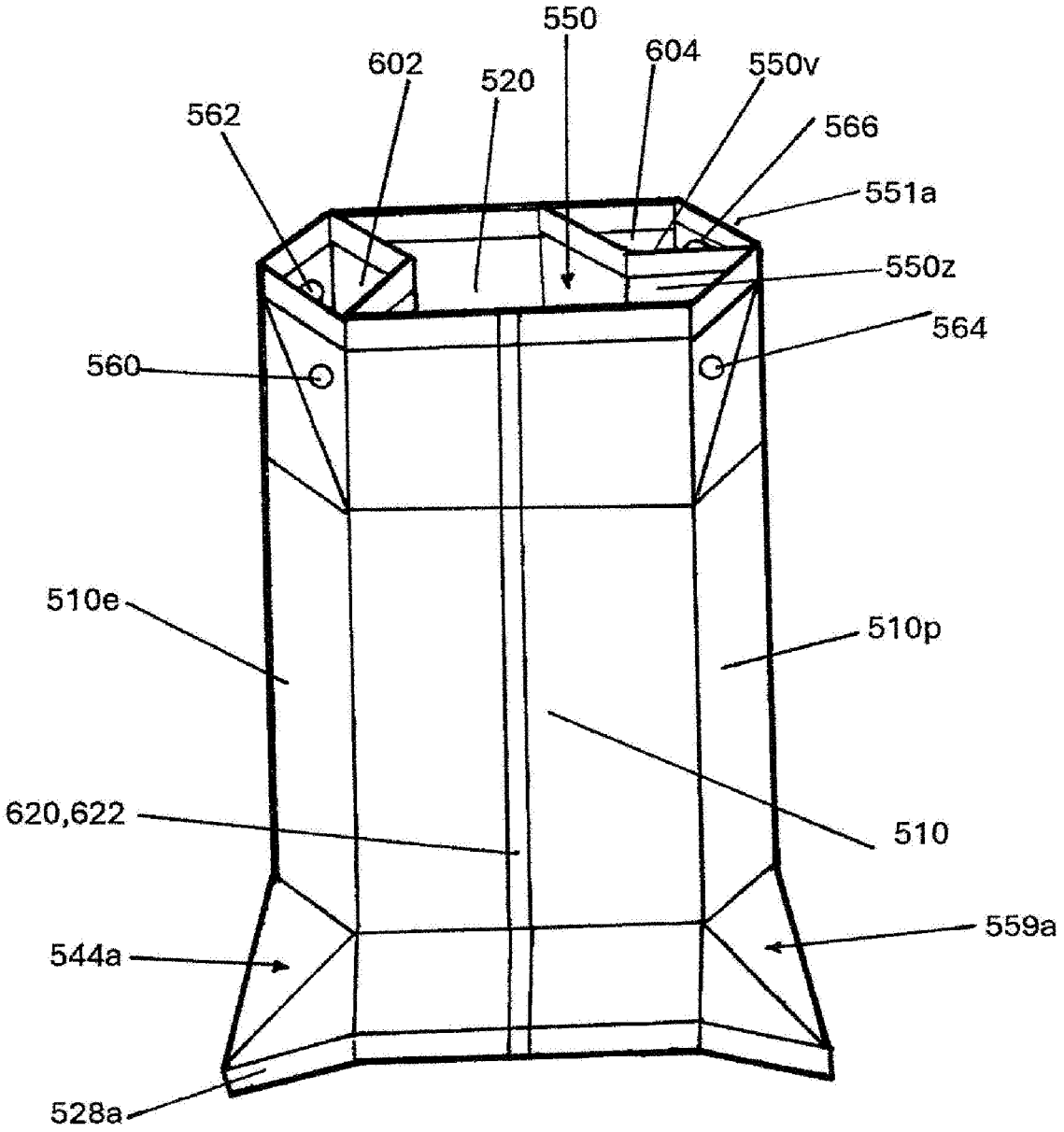
FIG. 20 is a perspective view of a fourth step of manufacturing the drink container of FIG. 15.
Figure 21:
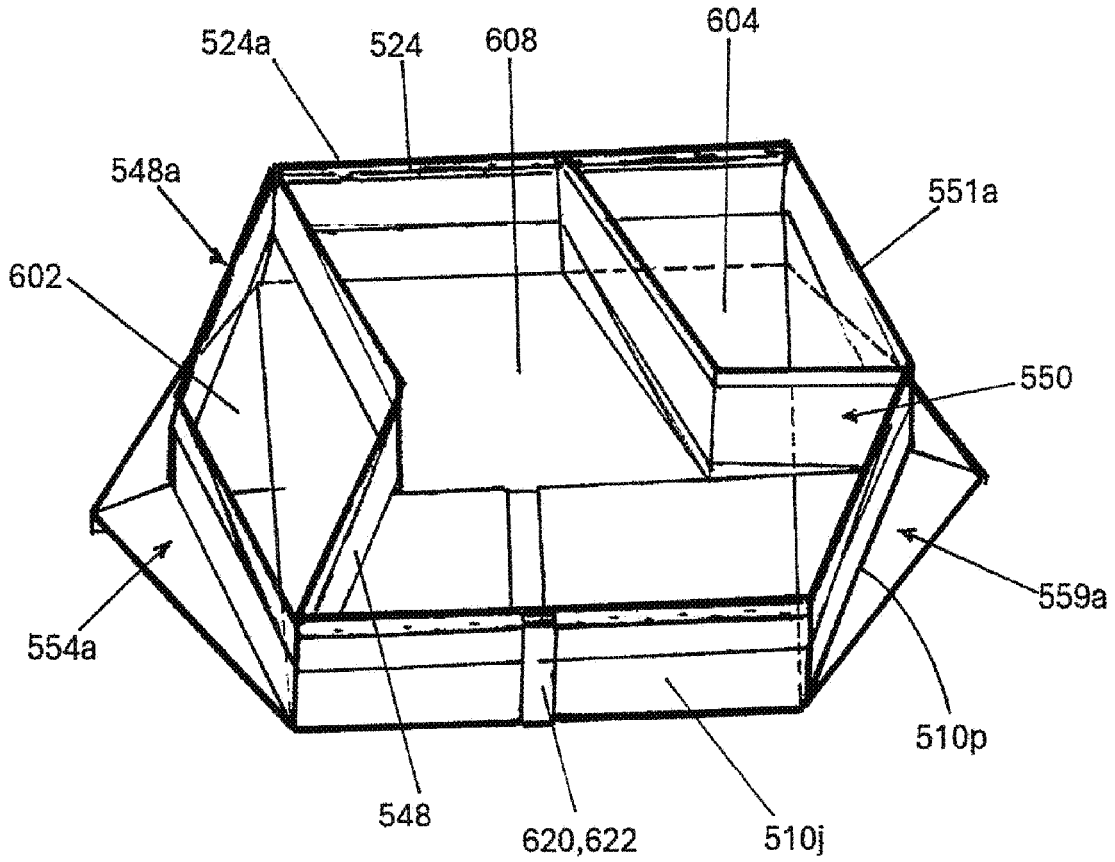
FIG. 21 is a top perspective view of FIG. 20.

As shown in FIGS. 17-19, a first vertical sealing band 620 can be provided on a left edge of the box and a second vertical sealing band 622 can be provided on the right edge. As shown in FIG. 6, the bands 620, 622 can be overlapped and sealed forming a vertical seam in the box.

FIGS. 20-23 show the container of FIG. 19 with the gusset areas 554*a*, 559*a* folded outward. The inner gusset areas 554, 559 fold outwardly to be in close conformity to the outer gusset areas 554*a*, 559*a*. The inner gusset area 550 has a first part 550*v* that folds inwardly and a second part 550*z* the folds outwardly. The first part 550*v* is spaced inwardly from the outer gusset area 550*a* to form the channel 604, while the second part 550*z* is folded outwardly to be in close contact with the outer gusset area 550*a*.

Figure 24:
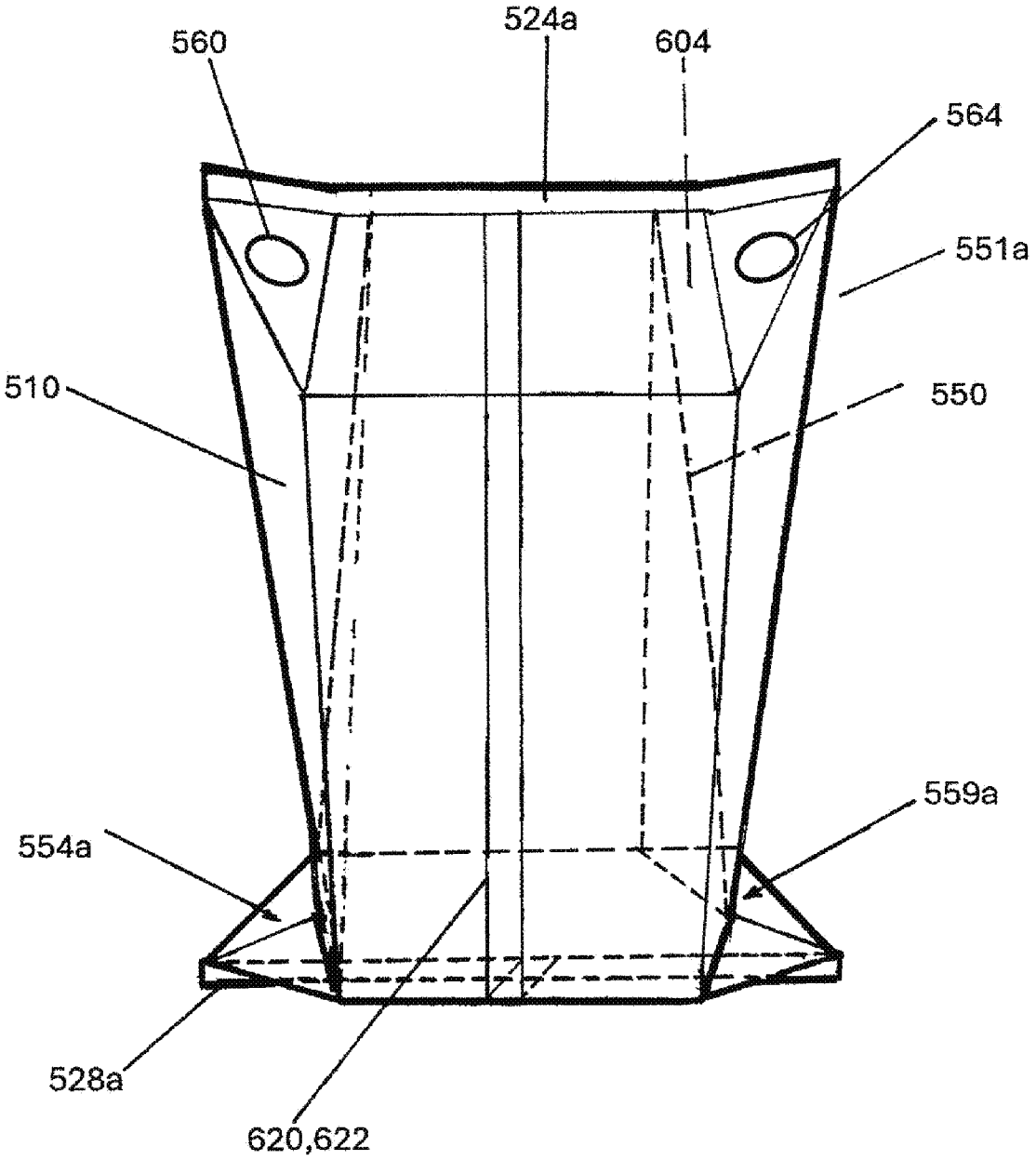
FIG. 24 is a front perspective view of a sixth step of manufacturing the drink container of FIG. 15.

FIG. 24 shows the top and bottom seals 524, 524*a* and 528, 528*a* after sealing between the top bands 525, 524*a*, the bottom bands 528, 528*a* and the vertical bands 620, 622.

Figure 25:
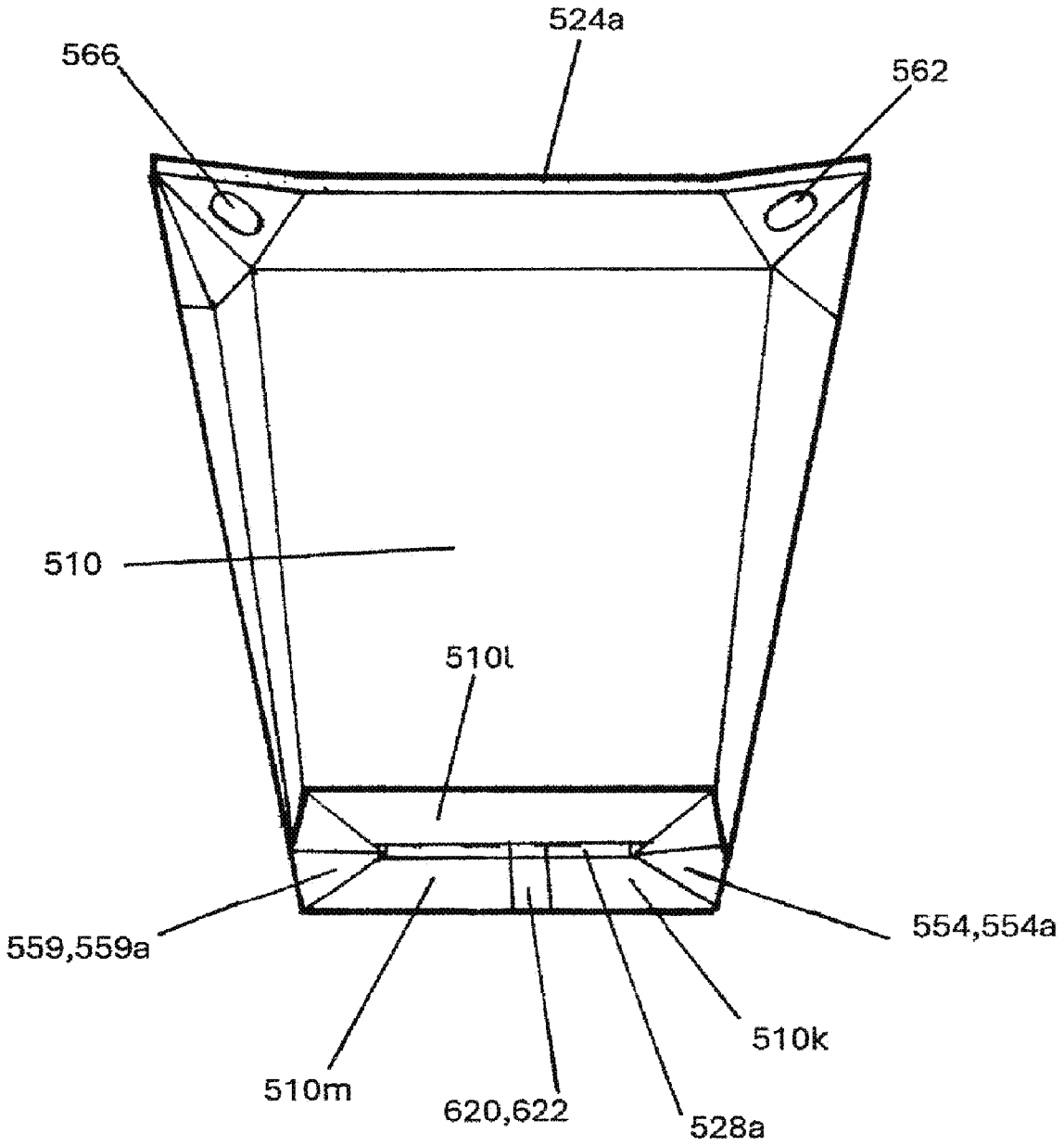
FIG. 25 is a bottom perspective view of a seventh step of manufacturing the drink container of FIG. 15.
Figure 26:
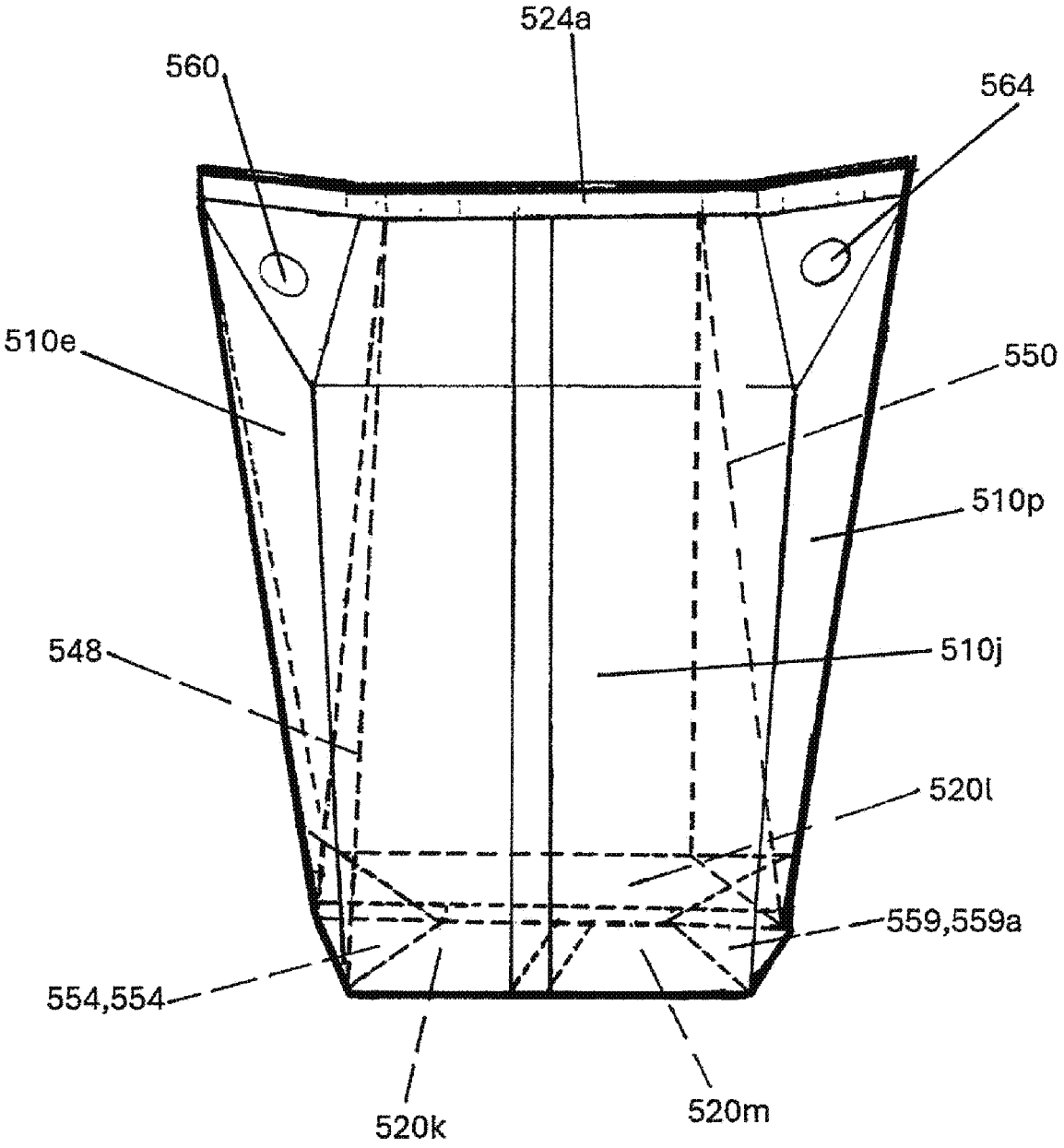
FIG. 26 is a front perspective view of the drink container shown in FIG. 23.

FIGS. 25 and 26 illustrates that the bottom bands 528, 528*a* have been folded flat and the gusset areas 554, 554*a* and 559, 559*a* have been folded under bottom walls 5101, 5201; 510*k*, 520*k*; 510*m*, 520*m* and sealed thereto.

FIGS. 25 and 26 show the gusset areas 554, 554*a*, and 559, 559*a* folded under bottom panels 510*l*, 510*k*, 510*m* and sealed thereto.

Figure 27:
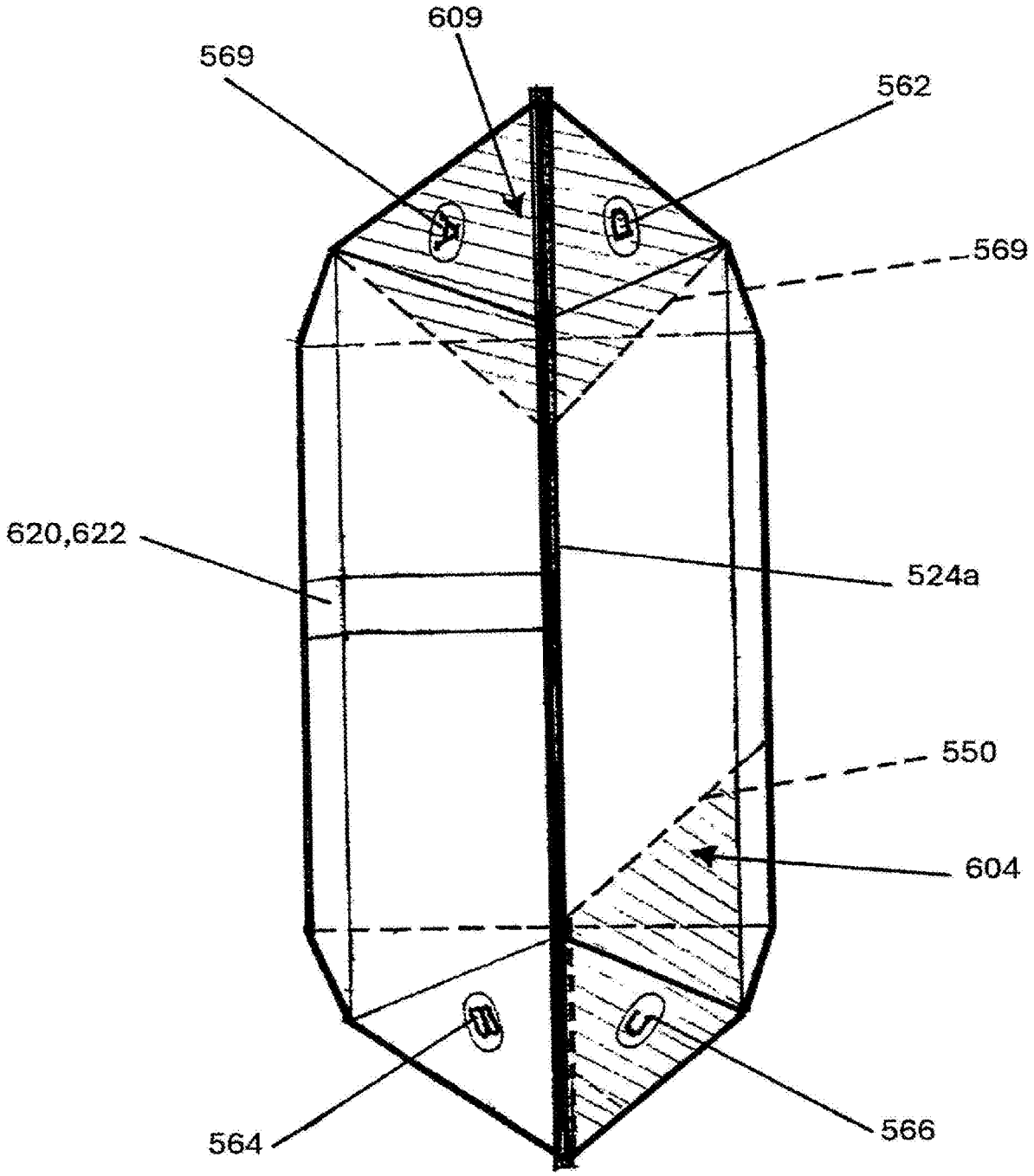
FIG. 27 is a top view of the drink container of FIG. 26.

FIG. 27 shows the weakened circles 560. 562 corresponding to answers "A" and "D" and weakened circles 564, 566 corresponding to answers "B" and "C." The correct answer in this example is answer "B" which, when penetrated, will provide access directly into the reservoir 608.

The channel 602 is sealed at the top and open behind the weakened circles 660, 662, but effectively closed along the fold line portions 546*aa*, 156*aaa* of the horizontal fold 546. The channel 604 is sealed at the top and open behind the weakened circle 566 but effectively closed along the fold line portions 546*bb*, 546*bbb* of the horizontal fold 146.

Figure 28:
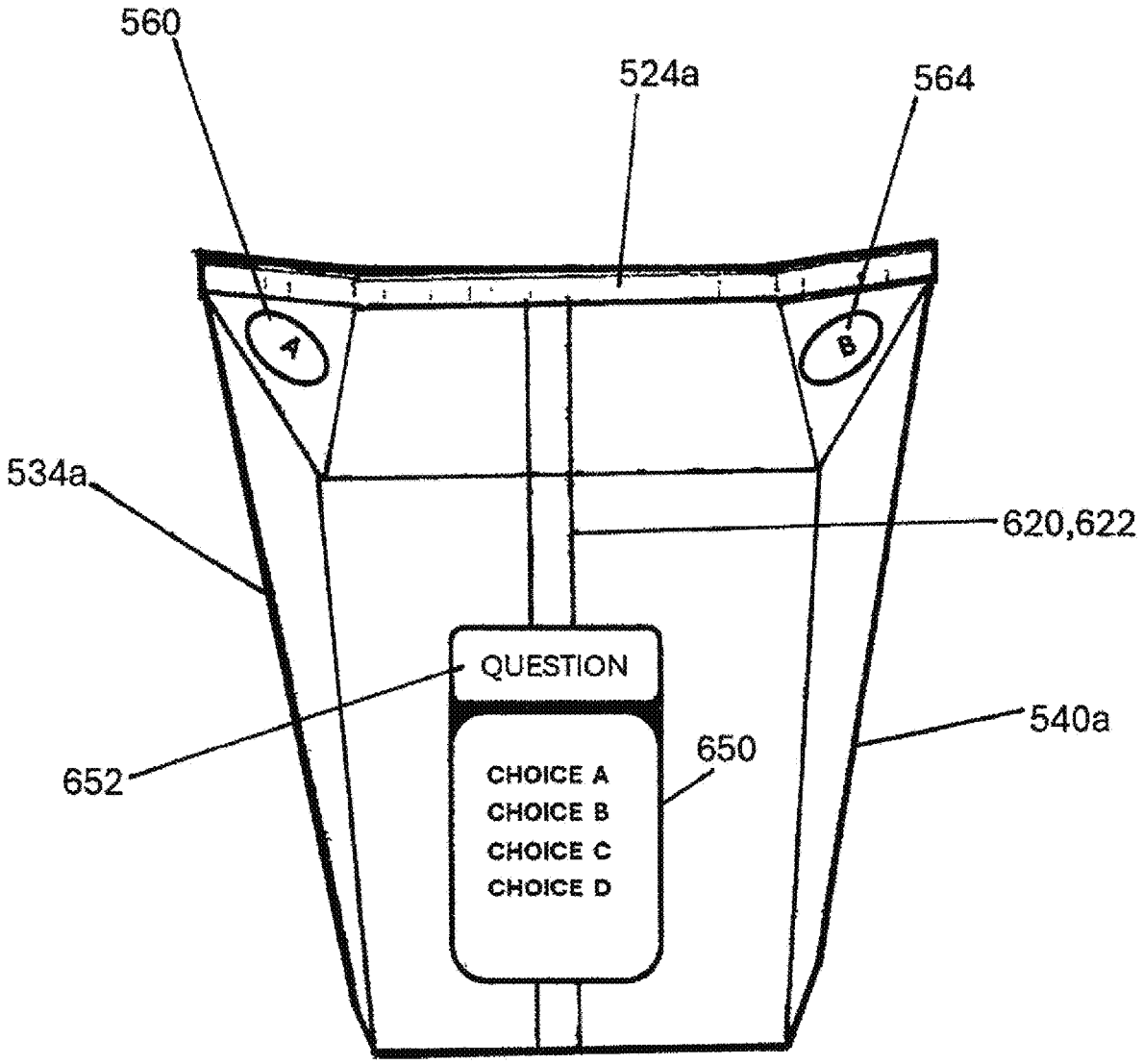
FIG. 28 is a front perspective view of the drink container shown in FIG. 26.

FIG. 28 shows the finished product. A label 650 is applied with a question 652 and four answer choices "A", "B", "C" and "D." The answer choice "A" corresponds to the weakened circle 560, the answer choice "B" corresponds to the weakened circle 564, the answer choice "C" corresponds to the weakened circle 562, and the answer choice "D" corresponds to the weakened circle 566. According to the illustrated embodiment, answer choice "B" would be the correct answer to the question and corresponds to the primary opening, and a straw pushed through the weakened circle 564 would deliver liquid from the reservoir 608 to the user sipping through the straw. The answer choices "A" and "C" would be incorrect answers and correspond to secondary openings, and a straw pushed through either weakened circles 560, 562 would access the closed channel 602 and no liquid would be delivered through the straw. The answer choice "D" would also be an incorrect answer and corresponds to a secondary opening, and a straw pushed through the weakened circle 566 would access the closed channel 604 and no liquid would be delivered through the straw. The manufacturing of the container would assure that the correct answer would alternately be "A", "B", "C" or "D" requiring the user to make a correct selection to access the reservoir 608.

Figure 29:
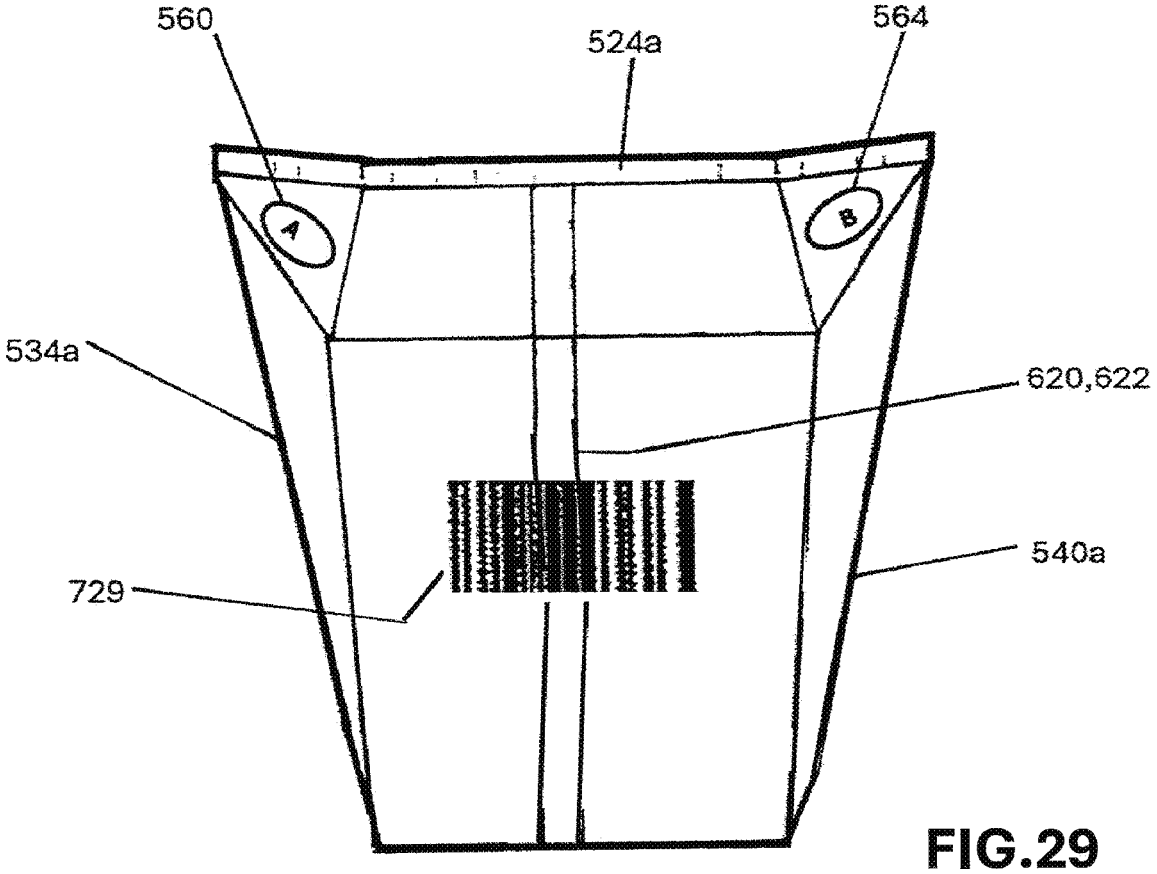
FIG. 29 is an alternate embodiment to that shown in FIG. 28.
Figure 30:
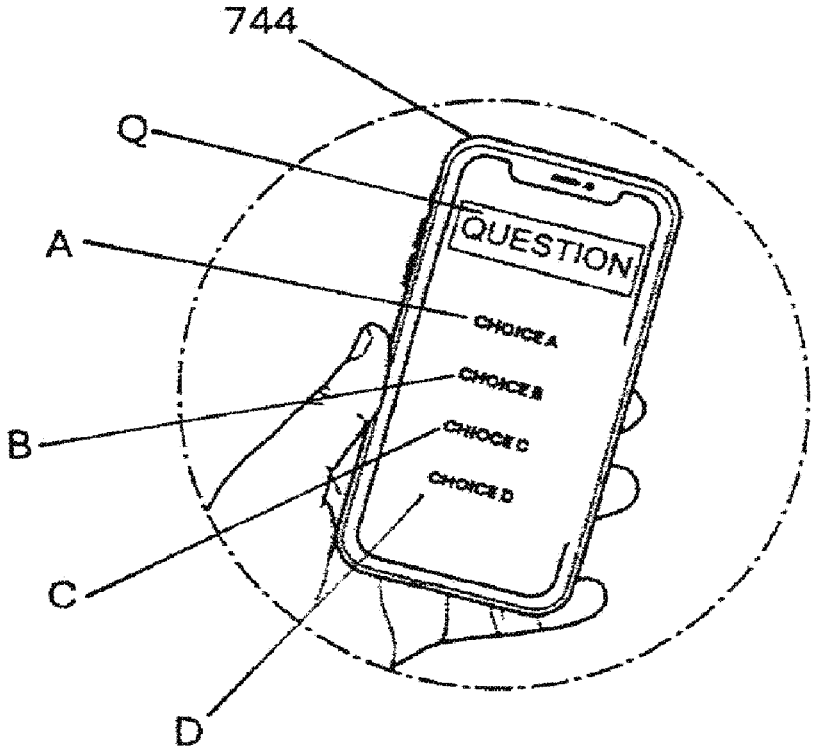
FIG. 30 is a schematic view of a smart phone reacting to the embodiment of FIG. 29.
Figure 31:
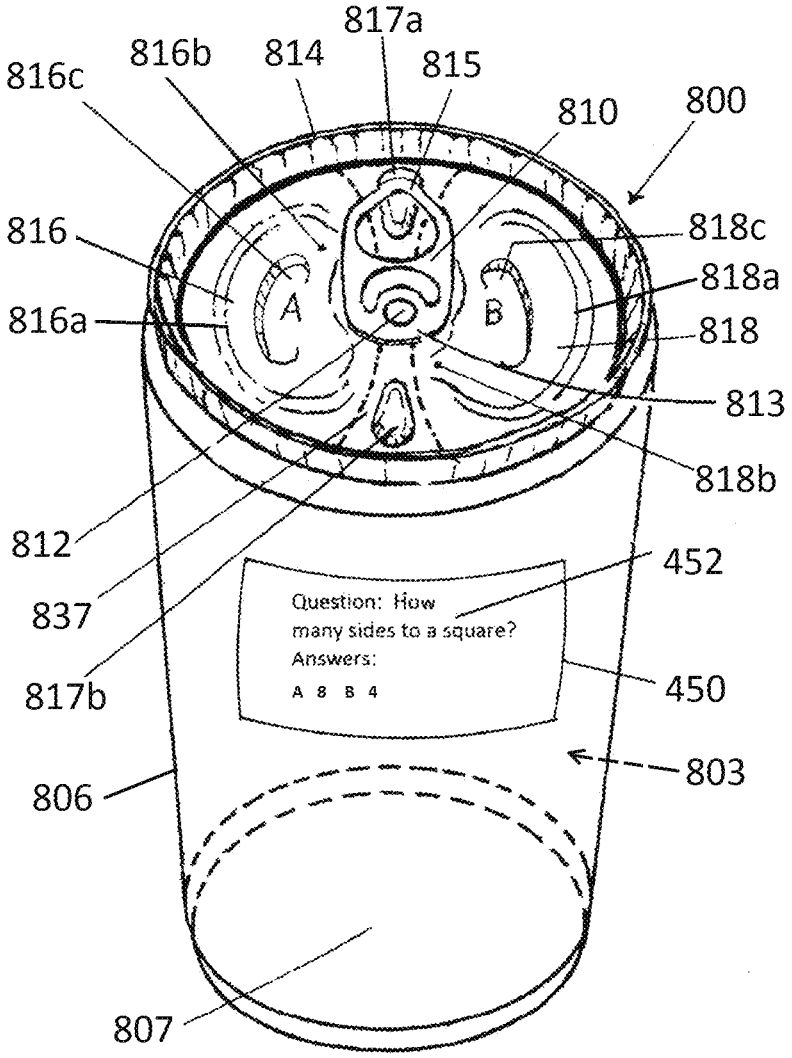
FIG. 31 is a perspective view of an exemplary embodiment beverage can of the invention.
Figure 32:
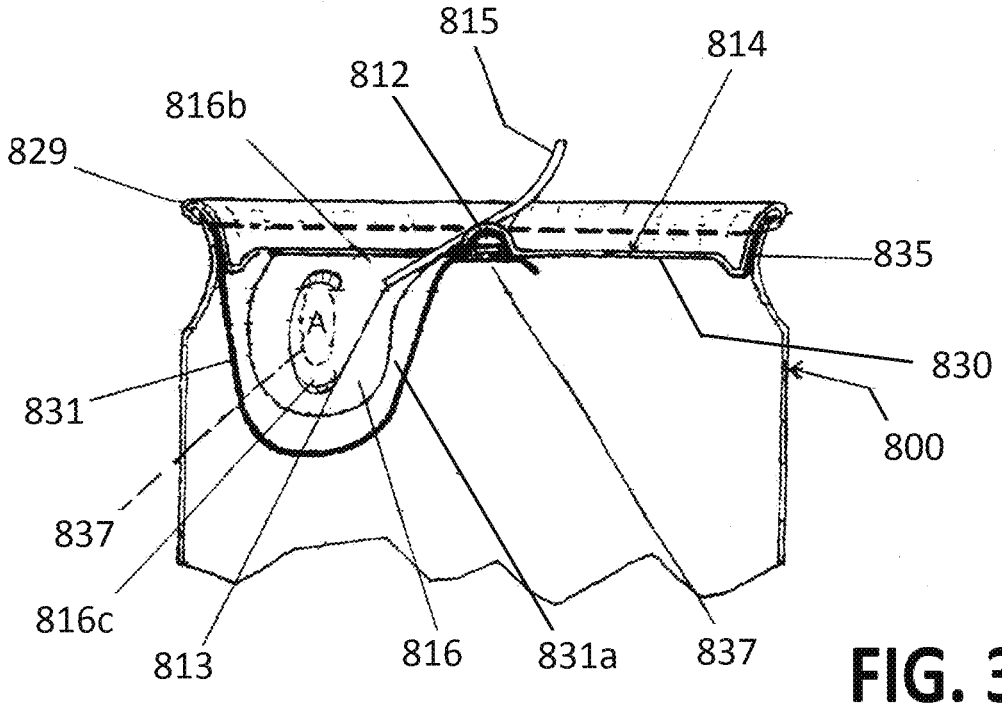
FIG. 32 is a fragmentary sectional view of the beverage can of FIG. 31, taken generally through plane 32-32 of FIG. 33 shown with one port opened.
Figure 33:
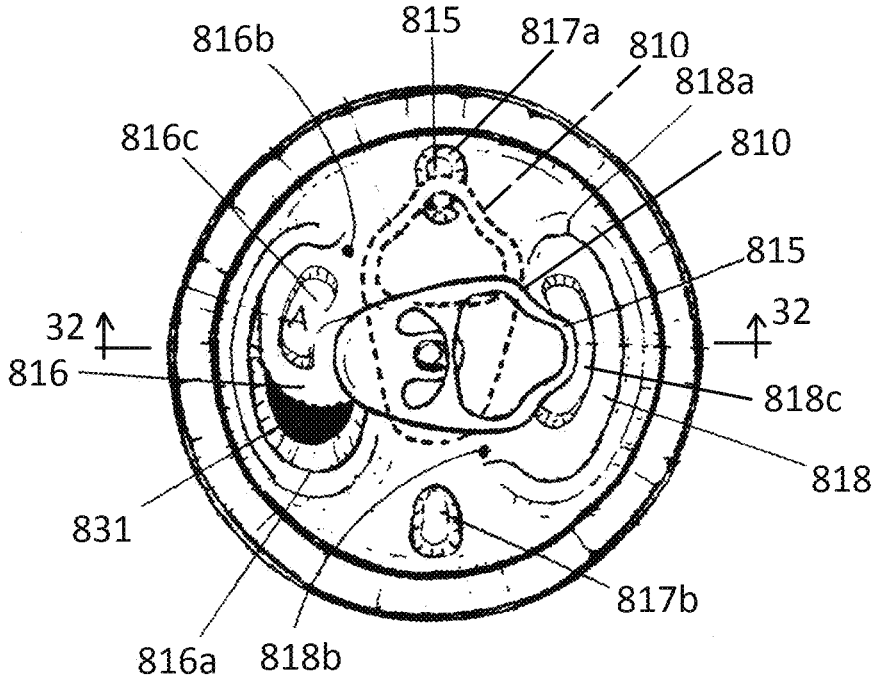
FIG. 33 is a top plan view of the embodiment shown in FIG. 33.
Figure 34:
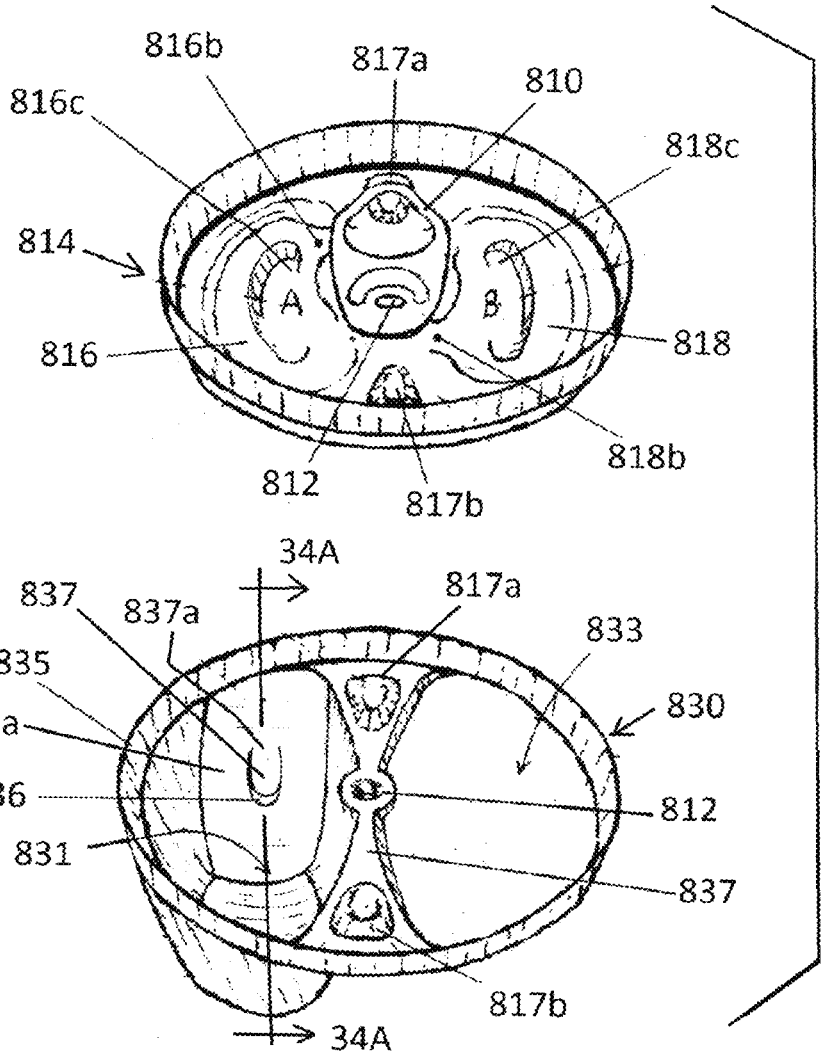
FIG. 34 is an exploded perspective view of a top portion of the beverage can of FIG. 31.
Figure 35:
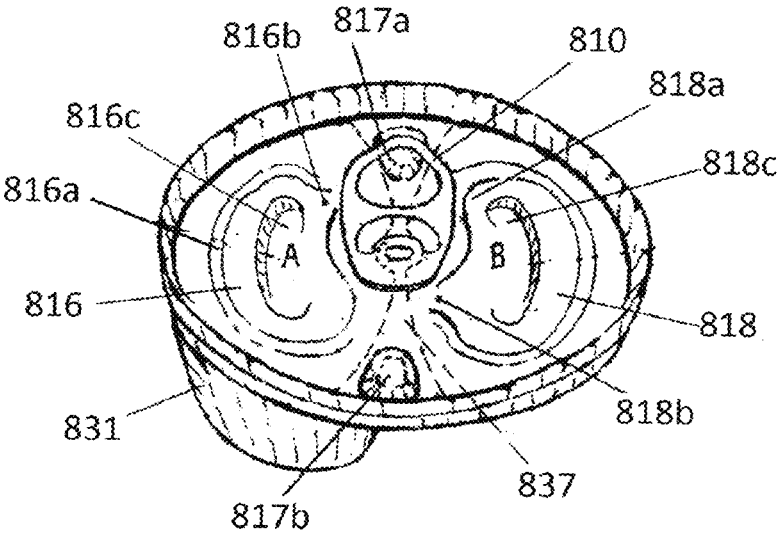
FIG. 35 is a perspective view of the top portion shown in FIG. 34, as assembled.
Figure 34A:
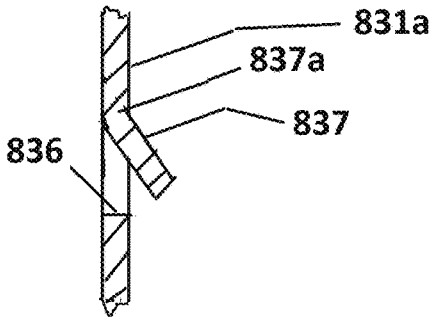
FIG. 34A is a fragmentary sectional view taken through the plane 34A-34A of FIG. 34.
Figure 36:
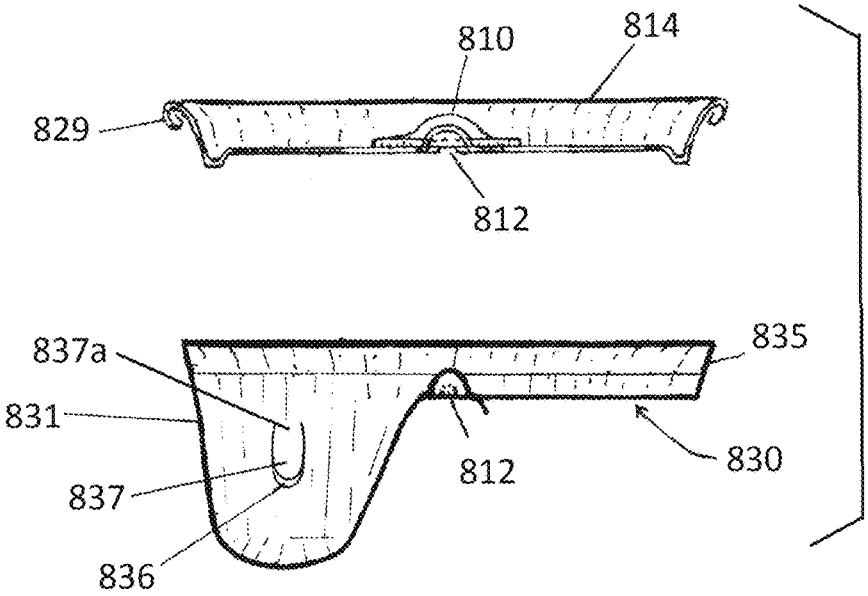
FIG. 36 is an exploded sectional view of the top portion shown in FIG. 34.
Figure 37:
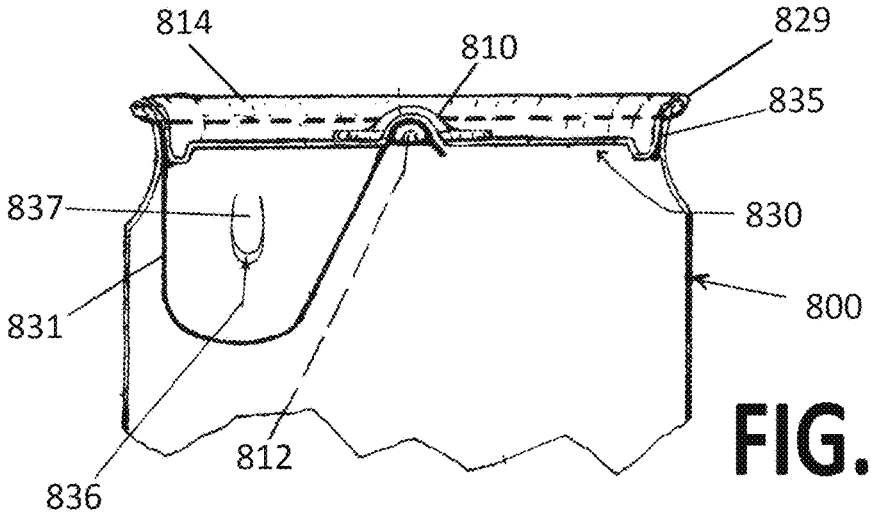
FIG. 37 is a sectional view of the top portion shown in FIG. 36, as assembled.
Figure 38:
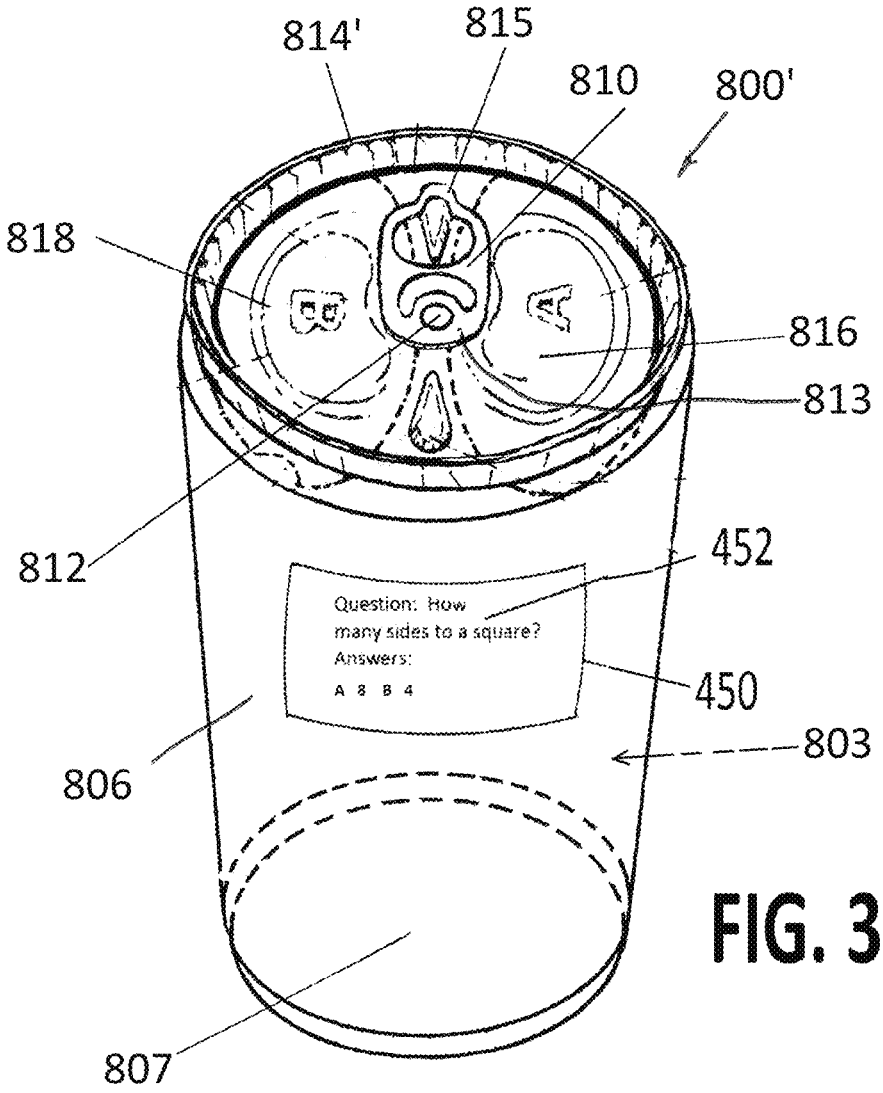
FIG. 38 is a perspective view of another exemplary embodiment beverage can of the invention.
Figure 39:
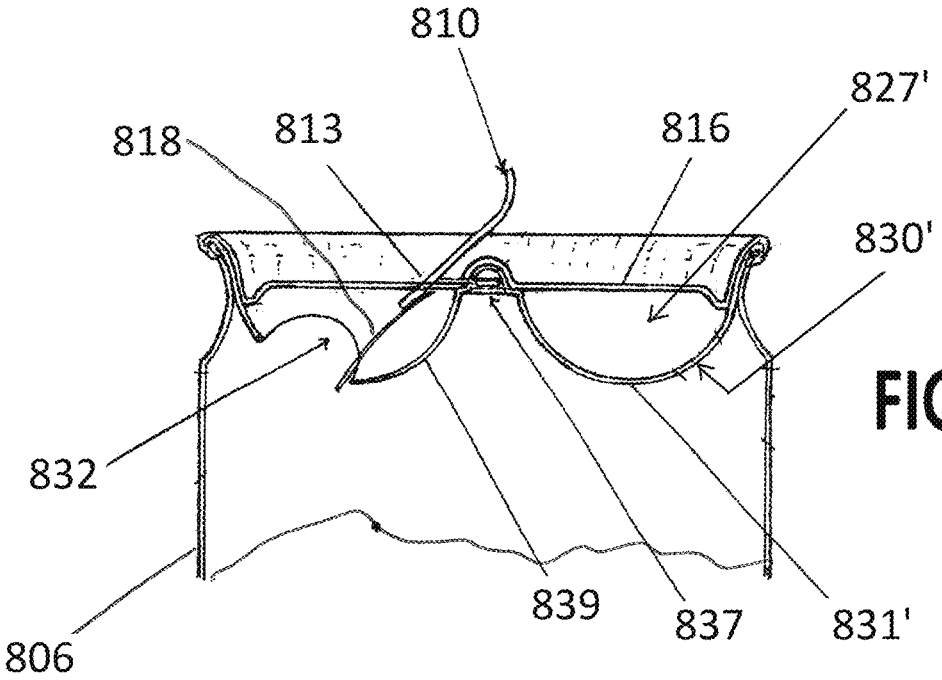
FIG. 39 is a fragmentary sectional view of the beverage can of FIG. 38, taken generally through plane 39-39 of FIG. 40 shown with one port opened.
Figure 40:
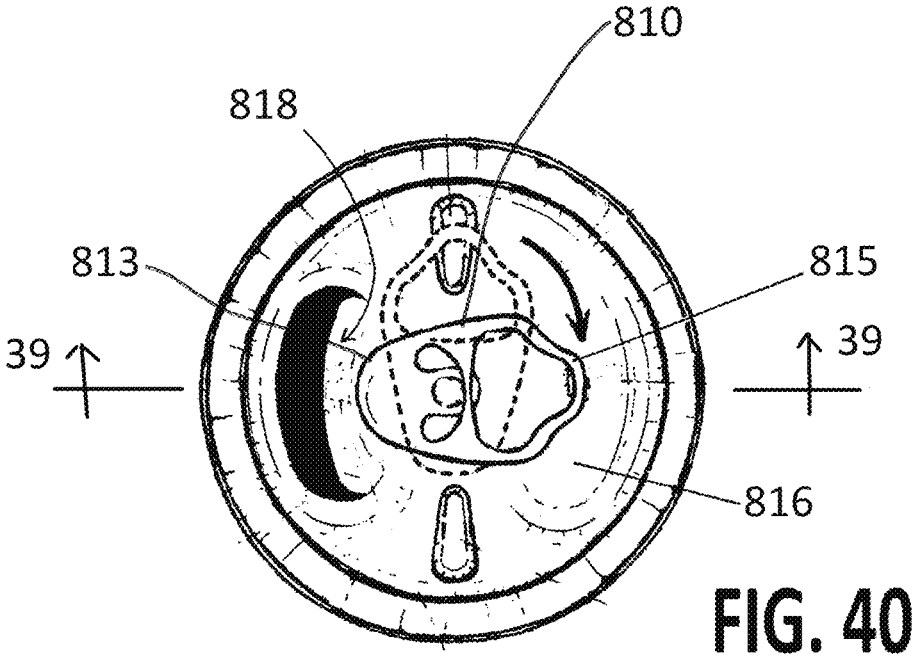
FIG. 40 is a top plan view of the embodiment shown in FIG. 39.
Figure 41:
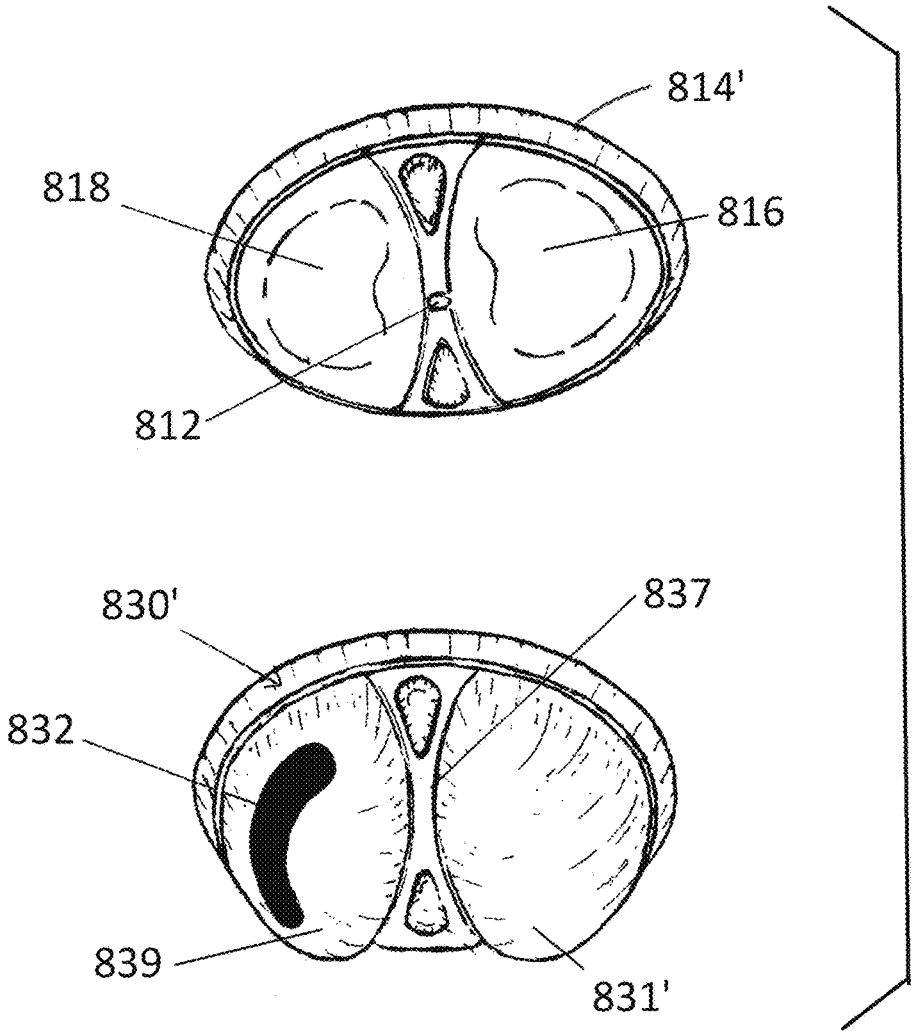
FIG. 41 is an exploded perspective view of a top portion of the beverage can of FIG. 38.
Figure 42:
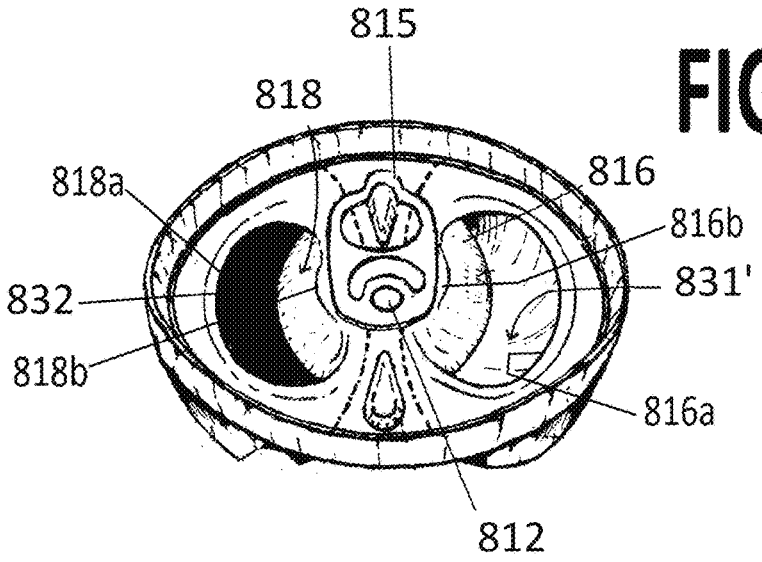
FIG. 42 is a perspective view of the top portion shown in FIG. 41, as assembled.

FIG. 29 shows an alternate embodiment wherein a physical label 650 is replaced with an electronic tag such as a bar code 729. The bar code is configured to be scanned by a mobile device 744, such as a smart phone (as shown in FIG. 30), such that a question Q and answer choices A, B, C and D will be displayed upon the mobile device (as shown in FIG. 30). The bar code may be of any suitable configuration to be scanned by a device, such as a traditional bar code, a QR code, or any similar representation. The multiple answers have an indicia, such as A, B, C, D which correspond to the selectable openings marked A, B, C, D on the top wall of the container as shown in FIG. 27.

Although the exemplary embodiment can be advantageously configured for the game or educational purpose, it is also encompassed by the invention that a multi-chamber container is provided that can have different chambers holding different products, liquid or solid.

FIGS. 31-37 Illustrate a further embodiment of the invention. According to this embodiment, a beverage can, such as a beer can or a soda can 800 includes a cylindrical sidewall 806, a bottom wall 807, a top wall 814, and a sub-wall 830. A primary chamber 803 is formed between the cylindrical sidewall 806, the bottom wall 807 and the sub-wall 830. A pull tab arrangement 810 (or "pop top") is rotationally attached to the top wall 814 by a rivet 812. The top wall 814 includes two wall portions 816, 818 with partial perimeters weakened such as to break under force, defining a primary port and a secondary port. Each wall portion 816, 818 has a predominant perimeter portion 816*a*, 818*a* respectively that is breakable or frangible and a minor perimeter portion 816*b*, 818*b* respectively that is not frangible and forms a respective bendable hinge. The pull tab 810 includes a pushing end 813 and a loop handle end 815. Raised stabilizer bumps 817*a*, 817*b* releasably retain the loop handle end on the top wall 814. As sold, the loop handle end can randomly be retained in either of the bumps 817*a*, 817*b* to further conceal the correct answer of the game, as described below.

By being rotated into a desired position, and the handle end 815 is pulled upward, the pushing end 813 cracks open a selected one of the wall portions 816, 818 around its weakened dominant perimeter 816*a* 818*a* and pivots the respective wall portion 816, 818 about its minor perimeter portion 816*b*, 818*b*. According to the drawing, the wall portion 816 is labeled "A" and the wall portion 818 is labeled "B." These labels correspond to answer selections as part of game or challenge, as described below. Sometimes these labels are reversed in the production of the cans in order to maintain secret the correct answer to the game, as described below.

Beneath the top wall 814 is the sub-wall 830. The top wall 814 and the sub-wall 830 are sealingly fixed to the cylindrical sidewall 806 around a rim 829 as is known. The sub-wall 830 is sealed to the top wall 814 around its perimeter 835 and across a diametric bridge 837, except for an opening 836 described below.

The sub-wall 830 includes a concave or depressed region 831 which allows for the wall portion 816 to be depressed downwardly into the depressed region 831. The depressed region 831 comprises a secondary chamber 827. The opening 836 is located through a wall 831*a* of the depressed region 831 and is overlaid by a flap 837 partially cut from the wall 831*a* of the depressed region 831. The flap 837 is cut from the wall 831*a* on three sides with a fourth side un-cut and acting as a bendable hinge 837*a*. The flap 837 is pivotable about the bendable hinge 837*a*. The flap 837 is initially displaced from the opening 836 to allow beverage to pass from the can into the depressed region 831, and substantially fill the depressed region 831. Beverage can flow between the can and the depressed region 831 until the flap 837 is forced to pivot about the film hinge 837*a* by force from the wall portion 816 to close the opening, as described below.

When a user opens the wall portion 816 by pivoting the pull tab arrangement to press the pushing end 813 down onto the wall portion, the predominant perimeter portion 816*a* around the wall portion 816 breaks and the wall portion 816 pivots about the bendable hinge formed by the minor perimeter portion 816*b*. The location of the minor perimeter portion is at an end region of the wall portion 816, such that the wall portion bends in a substantial tangential direction. The wall portion 816 includes an indent 816*c*. The wall portion 816 pivots to press an underside of the indent 816*c* against the flap 837 which bends to substantially close the opening 831. This inhibits or stops beverage flow from the primary chamber 803 into the depressed region 831. A user who opens the area 816 will be able to receive a sip of the beverage that was in the depressed region 831 but further flow of beverage into the depressed region is stopped or at least inhibited. The wall portion 818 also includes an identical indent 818*c*, which is non-functional, so that the wall portions 816, 818 appear identical, for purpose of playing the game as described below.

If the user opens the area 818 by pivoting the pull tab arrangement to press the pushing end 813 down onto the area 818, the predominant perimeter portion 818*a* around the area 818 breaks and bends about the minor perimeter portion 818*b*. The area 818 pivots into an open area 833 of the sub-wall 830 which provides user access to the primary chamber 803 of the can, as in a conventional pop-top beverage can. Since the opening 836 is at an elevated position on the can, when a user is tipping the can to drink from the primary port, wall portion 818, the opening 836 will be above the level of beverage in the can. Even if some beverage could leak past the flap 837, the opening 836 being above beverage level prevents this possibility.

The wall portion 818 constitutes a primary port, which communicates freely with the primary chamber 803. The wall portion 816 constitutes a secondary port which communicates with the secondary chamber 827 defined by the depressed region 831.

As described with the previous embodiments, a game or challenge can be presented to the user wherein a question and two possible answers are presented to the user either by a label on the can or by an electronically readable barcode or the like which presents the question and answers on an electronic device, such as a smart phone. For example, if the correct answer to a question is the selection "B", a user who rotates the pull tab 810 to crack open the wall portion corresponding to "A", will receive no beverage or limited amount of beverage through the wall portion 816 corresponding to "A". If the user rotates the pull tab 810 to crack open the wall portion corresponding to the marking "B" and this is the correct answer, fluid will flow through the sub-wall 830', through the open area 833 and to the user.

Only wall portion 818, once cracked open, will freely communicate beverage from the primary chamber 803 and out of the wall portion 818. Before opening one of the wall portions 816, 818, a user cannot ascertain from an unopened can which of the wall portions marked "A" or "B" will be in communication with the open area 833 through the sub-wall 830, or which of the wall portions marked "A" or "B" will instead be flow restricted through the opening 836 covered by the flap 837. During production, the labels "A" and "B" are assigned to the wall portions 816, 818 so that the label corresponding to the correct answer, whether it is "A" or "B" is assigned to the wall portion 818. In the illustrated embodiment of FIG. 31, "B" is the correct answer and is marked on wall portion 818.

Another exemplary embodiment beverage can 800' is shown in FIGS. 38-42. This embodiment is the same as the previous beverage can embodiment except as explained below. The opening 836 and flap 837 of the previous beverage can embodiment can be eliminated and a modified depressed region 831' of a modified sub-wall 830', under the wall portion 816, can be completely sealed to a modified top wall 814', forming a secondary chamber 827'. A user that opens the wall portion 816 would then receive no fluid at all, while a user that opens the area 818 would receive substantially unrestricted flow from the primary chamber 803. The sub-wall 830' also includes a recessed area 839 under the wall portion 818, with an opening 832 therethrough to give substantially unrestricted access to the primary chamber 803. Except for the opening 832, the structure of the sub-wall 830' is substantially identical under each area 816, 818.

In the embodiment of FIGS. 38-42, the minor perimeter portions 816*b*, 818*b* can be located substantially in the middle of the length of the wall portions 816, 818 such that when the pushing portion 813 opens the wall portions, the wall portions bend in a radial direction.

The wall portion 818 constitutes a primary port, which communicates freely with the primary chamber 803. The wall portion 816 constitutes a secondary port which communicates only with the secondary chamber 827' defined by the depressed region 831'.

As described with the previous embodiments, a game or challenge can be presented to the user wherein a question and two possible answers are presented to the user either by a label on the can or by an electronically readable barcode or the like which presents the question and answers on a electronic device, such as a smart phone. For example, if the correct answer to a question is the selection "B", a user who rotates the pull tab 810 to crack open the wall portion corresponding to "A", will receive no beverage through the wall portion 816 corresponding to "A". If the user rotates the pull tab 810 to crack open the wall portion corresponding to the marking "B" and this is the correct answer, fluid will flow through the sub-wall 830', through the opening 832 and to the consumer.

Only wall portion 818, once cracked open, will freely communicate fluid from the primary chamber 803 and out of the wall portion 818. Before opening one of the wall portions 816, 818, a user cannot ascertain from an unopened can which of the wall portions marked "A" or "B" will be in communication with the opening 832 through the sub-wall 830', or which of the wall portions marked "A" or "B" will instead deliver no beverage through the depressed area 831'. During production, the labels "A" and "B" are assigned to the wall portions 816, 818 so that the label corresponding to the correct answer, whether it is "A" or "B" is assigned to the wall portion 818. In the illustrated embodiment of FIG. 38, "B" is the correct answer and is marked on wall portion 818.

For both of the beverage can embodiments of FIGS. 31-42, the components can be composed or conventional beverage can materials, such as aluminum.

The game or challenge components, systems and methods for playing the game described in any of the disclosed embodiments are also applicable to any of the disclosed embodiments, including the embodiment of FIGS. 31-42.

Although the exemplary embodiment can be advantageously configured for the game or educational purpose, it is also encompassed by the invention that a multi-chamber container is provided that can have different chambers holding different products, liquid or solid.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

Although the exemplary embodiment can be advantageously configured for the game or educational purpose, it is also encompassed by the invention that a multi-chamber container is provided that can have different chambers holding different products, liquid or solid.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A multi-chamber container, comprising:

a housing defined by a bottom wall with a sidewall extending upward therefrom;

the housing including a top wall closing the sidewall, opposite of the bottom wall;

the housing defining a plurality of chambers;

the plurality of chambers comprising a primary chamber and a secondary chamber;

the housing defining a primary opening area, wherein the primary opening area provides access to the primary chamber;

the housing defining at least one secondary opening area, wherein each secondary opening area provides access to the secondary chamber;

wherein the housing is constructed of an inner sheet and an outer sheet, the inner sheet and outer sheet are folded together to form a primary channel and a secondary channel, the primary channel being openable at the primary opening area and the secondary channel being openable at the at least one secondary opening area, the primary channel being open into the primary chamber, and the secondary channel corresponds to the secondary chamber and being a closed channel separate from the primary chamber;

wherein the secondary channel is substantially wedge-shaped in cross section, converging from the top wall to the bottom wall.

2. The container according to claim 1, wherein the top wall and bottom wall are folded from the inner and outer sheets and sealed.

3. The container according to claim 1, wherein each of the primary opening area and secondary opening area is marked with a different indicator, and the indicators correspond to answers to a question, the question and answers provided by the housing, one indicator corresponding to a correct answer and the remaining indicators corresponding to incorrect answers, wherein the indicator corresponding to the correct answer is marked at the primary opening area.

4. The container according to claim 3, wherein the question and answers are provided printed on the housing.

5. The container according to claim 3, wherein the question and answers are provided printed by a code on the housing that is readable by a smart device.

6. The container according to claim 1, wherein the primary opening area and each of the secondary opening areas comprise a marked location on the top wall that is openable by penetration of a drinking straw.

7. The container according to claim 1, wherein the secondary channel is formed by the inner sheet being folded at a vertical fold line which is displaced at the top away from a vertical fold line of the outer sheet, and the inner sheet converges at the bottom wall to seal against the side wall and the bottom wall.

8. The container according to claim 1, wherein the primary channel is formed by the inner sheet being folded at a vertical fold line which is displaced away from a vertical fold line of the outer sheet, and the inner sheet having an opening accessing the primary chamber.

9. The container according to claim 1, wherein the bottom wall is flat and the top wall is tapered in an inverted V shape, wherein the top wall separates and seals the primary and secondary chambers.

10. The container according to claim 1, wherein the secondary channel is formed by the inner sheet being folded at a vertical fold line which is displaced away from a vertical fold line of the outer sheet.

11. A multi-chamber container, comprising:

a housing defined by a bottom wall with a sidewall extending upward therefrom;

the housing including a top wall closing the sidewall, opposite of the bottom wall;

the housing defining a plurality of chambers;

the plurality of chambers comprising a primary chamber and at least one secondary chamber;

the housing defining a primary opening area, wherein the primary opening area provides access to the primary chamber;

the housing defining at least one secondary opening area, wherein each secondary opening area provides access to a secondary chamber;

wherein the housing is constructed of an inner sheet and an outer sheet, the inner sheet and outer sheet are substantially co-extensive and folded together with portions of the inner sheet and the outer sheet folded to diverge to form at least one secondary channel therebetween that corresponds to the at least one secondary chamber.

12. The container according to claim 11, wherein the top wall and bottom wall are folded from the inner and outer sheets and sealed.

13. The container according to claim 12, wherein the bottom wall is flat and the top wall is tapered in an inverted V shape.

14. The container according to claim 11, wherein the housing comprises one secondary channel and one secondary chamber.

15. The container according to claim 11, wherein each of the primary opening area and secondary opening area is marked with a different indicator, and the indicators correspond to answers to a question, the question and answers provided by the housing, one indicator corresponding to a correct answer and the remaining indicators corresponding to incorrect answers, wherein the indicator corresponding to the correct answer is marked at the primary opening area.

16. The container according to claim 15, wherein the question and answers are provided printed on the housing.

17. The container according to claim 15, wherein the question and answers are provided printed by a code on the housing that is readable by a smart device.

18. The container according to claim 11, wherein the primary opening area and each of the secondary opening areas comprise a marked location on the top wall that is openable by penetration of a drinking straw.

19. A multi-chamber container, according to claim 11, wherein the inner sheet and the outer sheet are substantially identically configured in size and shape and having identical fold lines, wherein the inner sheet and the outer sheet are folded together in same directions along all fold lines except for the portions of the inner sheet being folded in a direction away from the outer sheet to form said secondary channel between the inner sheet and said outer sheet.

20. The container according to claim 19, wherein the top wall and bottom wall are folded from the inner and outer sheets and sealed.

21. The container according to claim 19, wherein each of the primary opening area and secondary opening area is marked with a different indicator, and the indicators correspond to answers to a question, the question and answers provided by the housing, one indicator corresponding to a correct answer and the remaining indicators corresponding to incorrect answers, wherein the indicator corresponding to the correct answer is marked at the primary opening area.

22. The container according to claim 21, wherein the question and answers are provided printed on the housing or readable by a smart device.

23. The container according to claim 19, wherein the primary opening area and each of the secondary opening areas comprise a marked location on the top wall that is openable by penetration of a drinking straw.

24. A multi-chamber container, comprising:

a housing defined by a bottom wall with a sidewall extending upward therefrom;

the housing including a top wall closing the sidewall, opposite of the bottom wall;

the housing defining a plurality of chambers;

the plurality of chambers comprising a primary chamber and at least one secondary chamber;

the housing defining a primary opening area, wherein the primary opening area provides access to the primary chamber;

the housing defining at least one secondary opening area, wherein each secondary opening area provides access to a secondary chamber;

wherein the housing is constructed of an inner sheet and an outer sheet, the inner sheet and outer sheet are folded together to form at least one secondary channel that corresponds to the at least one secondary chamber;

wherein the housing comprises two secondary channels and three secondary opening areas.

* * * * *